US006283871B1

(12) United States Patent
Briggs

(10) Patent No.: US 6,283,871 B1
(45) Date of Patent: Sep. 4, 2001

(54) PARTICIPATORY PLAY STRUCTURE HAVING DISCRETE PLAY ARTICLES

(75) Inventor: Rick A. Briggs, Springfield, IL (US)

(73) Assignee: Koala Corporation, Denver, CO (US)

( * ) Notice: Subject to any disclaimer, the term of this patent is extended or adjusted under 35 U.S.C. 154(b) by 0 days.

(21) Appl. No.: 09/133,505

(22) Filed: Aug. 12, 1998

Related U.S. Application Data

(63) Continuation of application No. 08/621,173, filed on Mar. 21, 1996, now Pat. No. 5,853,332, and a continuation-in-part of application No. 08/409,133, filed on Mar. 23, 1995, now Pat. No. 5,820,471, which is a continuation-in-part of application No. 08/333,373, filed on Dec. 16, 1994, now abandoned, which is a continuation of application No. 08/025,143, filed on Mar. 2, 1993, now Pat. No. 5,405,294, which is a continuation of application No. 07/604,946, filed on Oct. 29, 1990, now Pat. No. 5,194,048, which is a continuation-in-part of application No. 07/438,220, filed on Nov. 20, 1989, now Pat. No. Des. 330,579.

(60) Provisional application No. 60/002,605, filed on Aug. 21, 1995, now abandoned.

(51) Int. Cl.[7] ..... A63G 31/00

(52) U.S. Cl. ..... 472/136; 482/35; 124/16

(58) Field of Search ..... 472/116, 117, 472/128, 136; 482/35, 36, 37; 273/335; 124/16, 17, 23.1, 29.1, 36

(56) References Cited

U.S. PATENT DOCUMENTS

| | | |
|---|---|---|
| D. 330,579 | 10/1992 | Briggs . |
| D. 340,273 | 10/1993 | Ezell . |
| 2,977,118 | 3/1961 | Farkas . |
| 3,120,955 | 2/1964 | Carlin . |
| 3,141,670 | 7/1964 | Smyrni et al. . |
| 3,601,397 | 8/1971 | Carlin . |

(List continued on next page.)

FOREIGN PATENT DOCUMENTS

| | | |
|---|---|---|
| 32 42 358 | 5/1980 | (DE) . |
| 2031920 | 11/1970 | (FR) . |
| WO 96/29120 | 9/1996 | (WO) . |
| WO 97/06867 | 2/1997 | (WO) . |

OTHER PUBLICATIONS

Show Edition of "The Pentes Playball".
SCS Interactive Family Adventures brochures.
SCS Brochures Models 107—112 (Apr. 30, 1993).
SCS Brochures Models 115—212.
SCS Brochures Models 245—333 (Apr. 30, 1993).
SCS Brochures Model 400 (Nov. 15, 1994).
"The Pentes Playbill"—Newspaper of Pentes Play, Inc. Showtime 1995.
"The Pentes Playbill"—Newspaper of Pentes Play, Inc. Autumn 1995.
"The Pentes Playbill"—Newspaper of Pentes Play, Inc. Show Edition 1996.
"The Pentes Playbill"—Newspaper of Pentes Play, Inc. Spring 1997.
Pentes Play "Sampler Catalog".

*Primary Examiner*—Kien T. Nguyen
(74) *Attorney, Agent, or Firm*—David P. Wood; Snell & Wilmer, LLP

(57) ABSTRACT

An interactive play system and method of interactive play is provided in which a plurality of interactive play elements are provided for creating various desired effects utilizing soft foam balls or other suitable play media. The interactive play system comprises a multi-level support structure on which the interactive play elements are disposed. These allow play participants to create desired play effects using a fun and familiar play media. Some of the play elements may be multi-order play elements in that they receive play media from a first effect to create yet another effect. Various play-participant-operated conveyers are provided throughout the structure for transporting play media from a source to the various interactive play elements.

29 Claims, 32 Drawing Sheets

U.S. PATENT DOCUMENTS

| | | |
|---|---|---|
| 3,633,560 | 1/1972 | De Freitas . |
| 3,662,729 | 5/1972 | Henderson . |
| 3,905,349 | 9/1975 | Nielson, et al. . |
| 3,938,272 | 2/1976 | Ditto et al. . |
| 3,989,027 | 11/1976 | Kahelin . |
| 4,046,131 | 9/1977 | Clark et al. . |
| 4,159,113 | 6/1979 | Callecod . |
| 4,165,729 | 8/1979 | Niemirow . |
| 4,251,069 | 2/1981 | Beller . |
| 4,261,319 | 4/1981 | Dixon . |
| 4,262,900 | 4/1981 | Vinson . |
| 4,303,247 | 12/1981 | Fain . |
| 4,951,644 | 8/1990 | Bon . |
| 5,000,155 | 3/1991 | Gallagher . |
| 5,113,842 | 5/1992 | Moormann . |
| 5,115,794 | 5/1992 | Moormann . |
| 5,194,048 | 3/1993 | Briggs . |
| 5,224,701 | 7/1993 | Sciarrillo . |
| 5,343,849 | 9/1994 | Steer . |
| 5,378,197 | 1/1995 | Briggs . |
| 5,417,435 | 5/1995 | Peretz . |
| 5,431,410 | 7/1995 | Hampton . |
| 5,435,570 | 7/1995 | Labrasseur . |
| 5,447,144 | 9/1995 | Ivy . |
| 5,673,918 | 10/1997 | Bigari . |

FIG. 27A
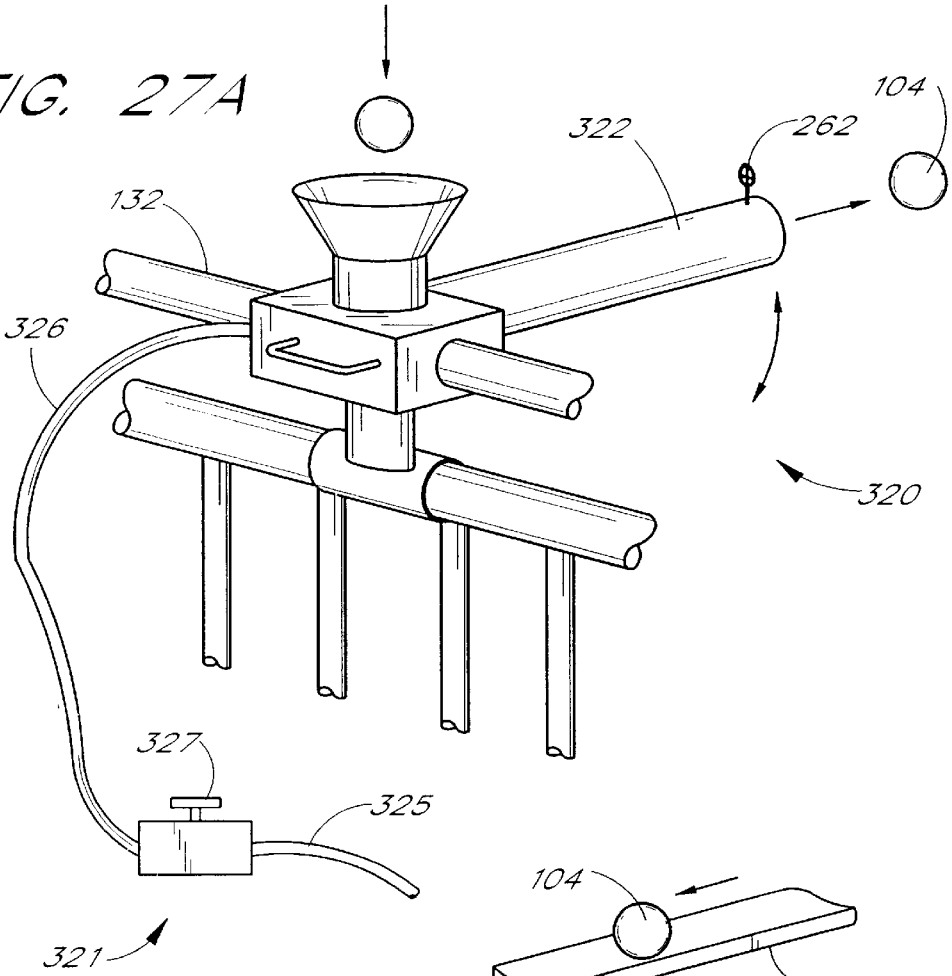
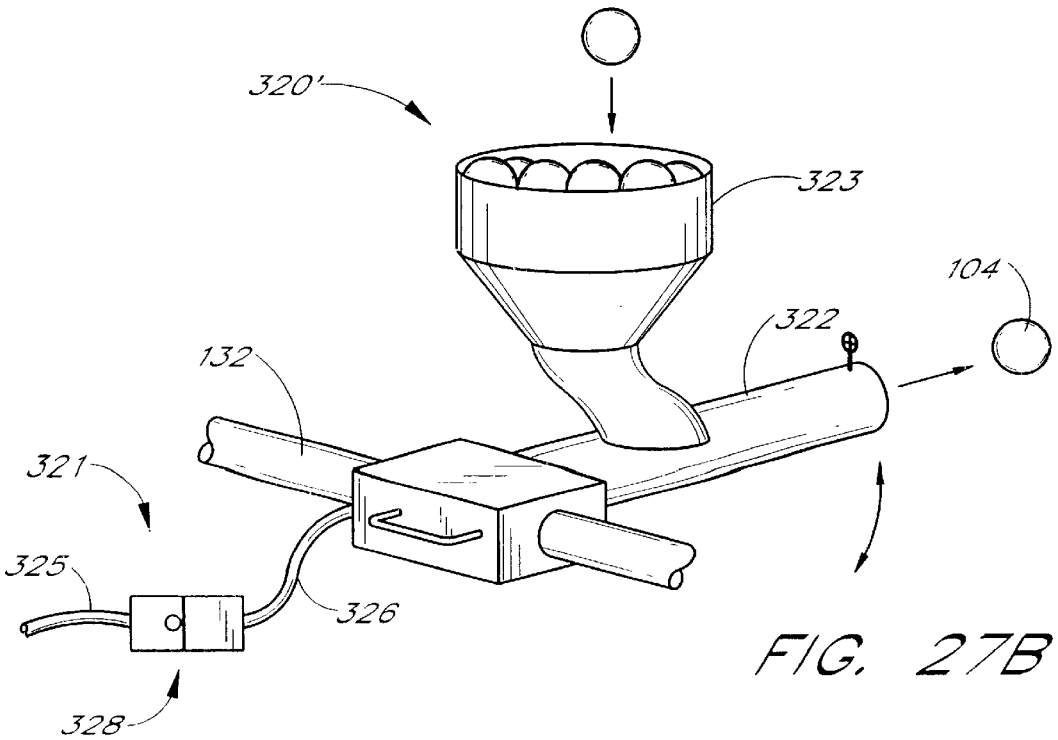
FIG. 27B

PARTICIPATORY PLAY STRUCTURE HAVING DISCRETE PLAY ARTICLES

RELATED APPLICATIONS

This application is a continuation of U.S. application Ser. No. 08/621,173 filed Mar. 21, 1996, now U.S. Pat. No. 5,853,332, which is a continuation of U.S. Provisional Application Ser. No. 60/002,605, filed Aug. 21, 1995, now abandoned and is also continuation-in-part of U.S. application Ser. No. 08/409,133 filed Mar. 23, 1995 now U.S. Pat. No. 5,820,471 entitled Interactive Water Play System, which is a continuation-in-part of U.S. application Ser. No. 08/333,373 filed Dec. 16, 1994, now abandoned entitled Participatory Water Play Apparatus, which is a continuation of U.S. application Ser. No. 08/025,143, filed Mar. 2, 1993, now U.S. Pat. No. 5,405,294, which is a continuation of U.S. application Ser. No. 07/604,946, filed Oct. 29, 1990, now U.S. Pat. No. 5,194,048, which is a continuation-in-part of U.S. application Ser. No. 08/438,220, filed Nov. 20, 1989, now U.S. Pat. No. D330,579.

BACKGROUND OF THE INVENTION

1. Field of the Invention

The present invention relates generally to the field of children's play structures and, in particular, to interactive play structures for safely entertaining and educating young and intermediate age children and adults.

2. Description of the Related Art

There has been a recent proliferation of commercial play structures designed to meet the recreational needs of young families. Such play structures can provide a safe and exciting alternative to more traditional parks and playgrounds. Conventional commercial play structures may be adopted either for water ("wet") play or for nonwater ("dry") play, as desired. The subject invention relates particularly to dry interactive play structures for either indoor or outdoor use.

A typical dry play structure may include a padded framework and cushioned floors defining a variety of play elements or areas. Slides, tunnels, net bridges, and ladders may be used to interconnect the various play elements and play areas together so that play participants can traverse from one play element or area to the next.

One popular play element is a ball pit. Small, lightweight, hollow plastic balls fill an enclosed pen area of a predetermined depth. Children jump into the pen and are partially or fully submerged in the balls. Children may also throw the balls in the air or at one another. Other typical play elements may include viewing towers, rope swings, soft hanging bags and rotating padded drums and the like.

A drawback of conventional dry play structures is that they are "passive." That is, they are normally static or react only to forces imparted directly by the play participants. While such passive play structures are modestly entertaining, they lack the creative stimulation and excitement of interactive play that stimulates the imaginations and creative inspirations of young and intermediate-aged children.

SUMMARY OF THE INVENTION

My U.S. Pat. No. 5,194,048 and related design patent D330,579, both of which are incorporated herein by reference as though fully reproduced herein, first disclosed the concept of "interactive waterplay" in which play participants can operate any one of a number of valves to adjust the amount of water spraying from one or more associated water effects. Play participants adjust the various valves and can immediately observe the change in the rate of water flowing from the various associated water effects.

Interactive waterplay allows children to experiment with and learn about cause-and-effect reactions using a familiar and entertaining medium, namely water. Small children, particularly, can benefit from the fun learning experiences garnered from such interactive play. See, for example, my copending U.S. application Ser. No. 08/409,133 filed Mar. 23, 1995, and incorporated herein by reference as though fully reproduced herein.

Many large-scale successful commercial water parks now incorporate interactive waterplay structures of the type disclosed in my U.S. Pat. No. 5,194,048. Families that have patronized these commercial water parks have discovered for themselves the valuable entertainment and educational benefits that interactive play provides. Sales of admission tickets for many such commercial water parks have surged following the introduction of new interactive waterplay structures.

The present invention expands on my previous inventions by extending the concept of interactive play to a wide variety of other fun and exciting play mediums which allow an even greater variety of stimulating and entertaining play activities. Such interactive play structures have broad application, since they are not limited to water theme parks or other similar play areas having a capacity for water containment, filtering and recirculation. Moreover, the use of various "dry" play media affords possibilities for play activities which incorporate a wide range of fun and exciting mechanisms, such as springs, cams, pulleys, gears, and the like, all of which can be employed to provide an interactive play experience which is both fun and, at the same time, educational.

In one embodiment the present invention provides an interactive play structure in which various play media, such as foam balls or other articles, are propelled, accelerated or otherwise transported from one location to another in the play structure in response to various play-participant controlled actuators.

In another embodiment the present invention provides a play structure for facilitating multiple-order interactive play. A first interactive play element is provided which is responsive to a corresponding play participant-activated actuator to create a first desired effect. A second interactive play element receives play media from the first effect to create yet a second desired effect. By controlling the various interactive play elements, a play participant or a group of play participants can observe and experiment with various cause-and-effect reactions involving multiple-order play effects.

In another embodiment the present invention provides an interactive play structure for facilitating interaction between play participants who are remotely located from each other. A propelling device may be mounted at a first location on the play structure, play media for the device may be supplied at an inlet at a second location on the structure and an actuator for the device may be located at yet a third location. Play media obtained from the second location can be fed to the device at the first location, and a play participant at the third location can activate the device to launch play media at a target or unsuspecting play participants.

In another embodiment the present invention provides an exciting play effect comprising a giant bucket or container for collecting play media. The container is balanced and conditionally stable such that it periodically spills over when the level of its contents reaches a predetermined level. This creates dramatic visual and tactile effects for surprising, entertaining, and amusing play participants.

In another embodiment the present invention provides an interactive conveyor system which can be operated by one or more play participants to transport play media from one location on a support frame to another location. The first location may be a discharge collection area of one or more interactive play elements, devices, and the second location may be a supply area for the same or other play elements. Play media may be recycled for reuse in the various devices using the efforts of play participants.

These and other features and advantages of the present invention will become readily apparent to those skilled in the art from the following detailed description of the preferred embodiments having reference to the accompanying drawings, the invention not being limited to any particular preferred embodiment disclosed.

BRIEF DESCRIPTION OF TIE DRAWINGS

FIG. 27A is a perspective view of a solenoid activated accelerator having features of the present invention;

FIG. 27B is a perspective view of an alternative embodiment of a solenoid activated accelerator having features of the present invention;

DETAILED DESCRIPTION OF THE PREFERRED EMBODIMENTS

Figure 1:
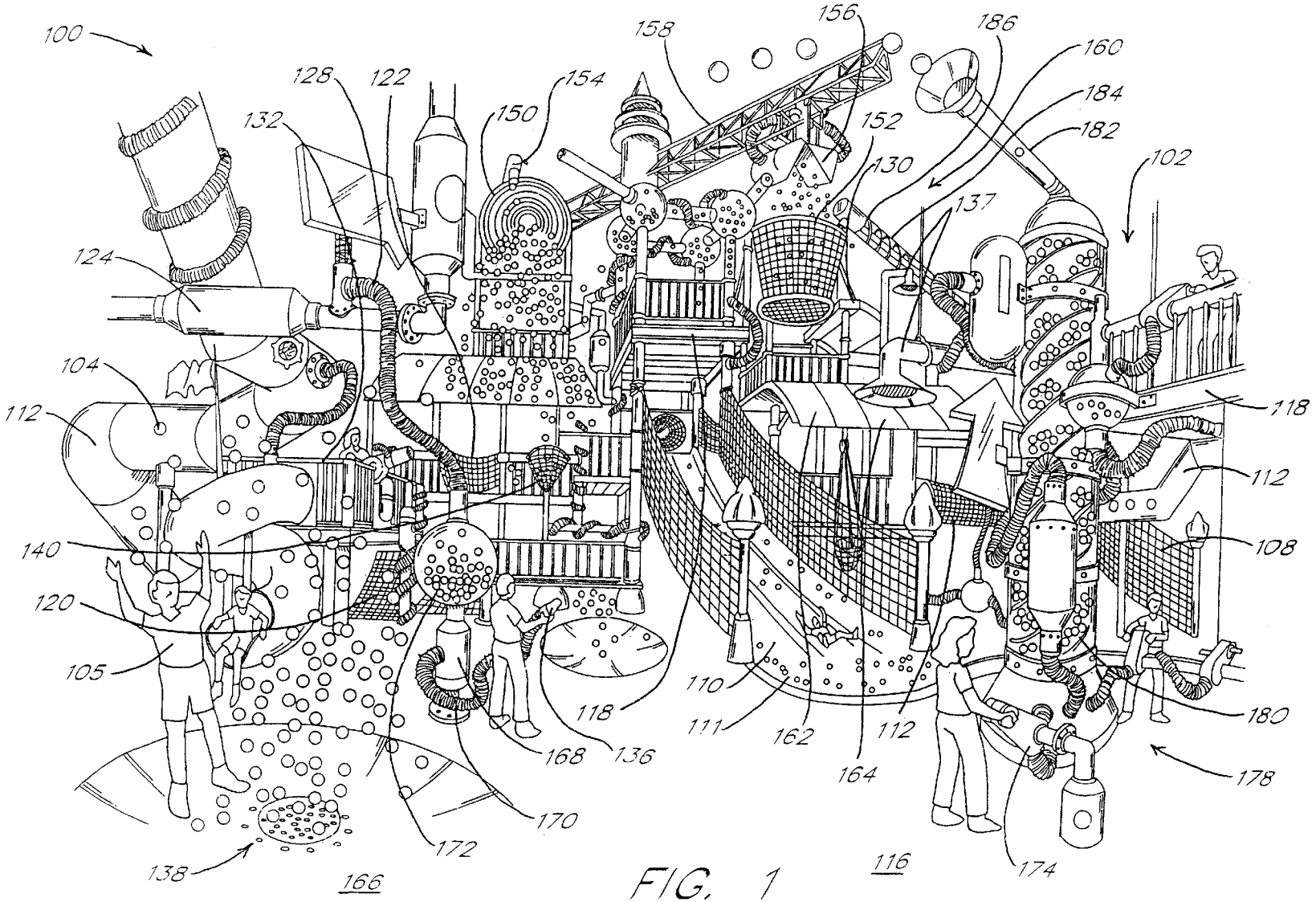
FIG. 1 is a perspective view of one preferred embodiment of an interactive play structure having features of the present invention.
Figure 2:
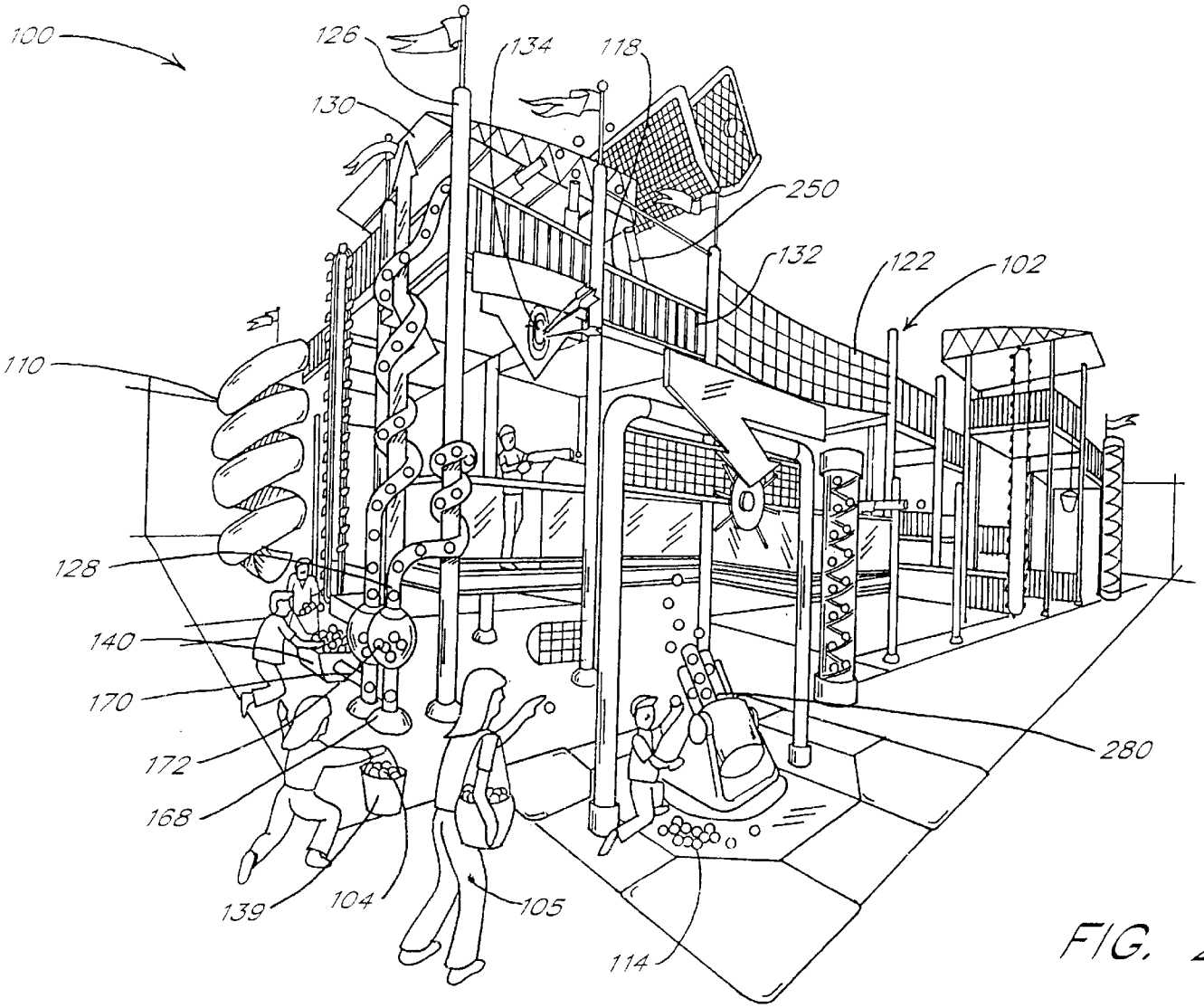
FIG. 2 is a perspective view of another preferred embodiment of an interactive play structure having features of the present invention.

FIGS. 1 and 2 are perspective views of one preferred embodiment of an interactive play structure 100 having features and advantages in accordance with the present invention. The particular interactive play structure shown is provided in the theme of a futuristic city with thousands of soft foam balls providing a familiar and entertaining play medium. Of course, those skilled in the art will readily appreciate that the present invention may be implemented in accordance with a wide variety of other possible embodiments and exciting play themes using any combination of familiar and fun play media. For example, a medieval castle, lost temple, military fort or fire station can each provide an exciting play theme for an interactive play structure having features and advantages as taught herein. Interactive play media may include, without limitation, such diverse items as tennis balls, rubber balls, beach balls, balloon balls, frisbees, foam darts/arrows, snow, mud, water-balloons, slime, as well as a variety of other fun and exciting play media well known to those skilled in the art.

The following table is provided for convenience in describing elements of the invention as shown in FIGS. 1–4:

TABLE 1

| Ref. | Description |
|---|---|
| 100 | Play Structure |
| 102 | Support Frame |
| 104 | Play Media |
| 105 | Play Participant |
| 107 | Play Zone |
| 108 | Net Ladder |
| 110 | Slide |
| 111 | Ball Pit |
| 112 | Tunnel |
| 116 | Ground Level |
| 118 | Elevated Platform |
| 120 | Stairs |
| 122 | Bridge |
| 124 | Conduit |
| 126 | Framing Element |
| 128 | Flexible Hose |
| 130 | Roofing Element |
| 132 | Railing |
| 134 | Target |
| 136 | Fire Hose Nozzle |
| 137 | Shower Nozzle |
| 138 | Geyser |
| 139 | Bucket |
| 140 | Collector |
| 142 | Bucket |
| 150 | Giant Basket (Left) |
| 152 | Giant Basket (Right) |
| 154 | Spout |
| 156 | Giant Scoop |
| 158 | Crane |
| 160 | Archimedes Screw |
| 162 | Deflection Shield |
| 164 | Shied Opening |
| 166 | Sump Basin |
| 168 | Holding Tank |
| 170 | Flexible Hose |
| 172 | Collector Relay |
| 174 | Actuator |
| 178 | Archimedes Blaster |
| 182 | Nozzle |
| 184 | Cylinder |
| 200 | Spring Catapult |
| 210 | Counterweight Catapult |
| 220 | Basket Catapult |
| 230 | Crossbow |
| 240 | Machine Gun |
| 250 | Pump Gun |
| 270 | Plunger Gun |
| 280 | Cannon |
| 290 | Compressed Air Gun |
| 300 | Bellows Gun |
| 320 | Pneumatic Gun |
| 420 | Screw Conveyor |
| 430 | Main Sump |
| 432 | Collection Lines |

Supporting Framework

As shown in FIGS. 1–4, the play structure 100 basically comprises a multi-level structure constructed using any one of an number of materials and construction techniques well known to those skilled in the art. The structure 100 may be suitable for either outdoor or indoor use, as desired. Preferably, the structure 100 comprises a supporting framework 102 formed from a plurality of interconnected support members 126, comprising columns, pylons, beams, connectors and the like. The support members 126 may be formed from any combination of convenient materials having sufficient strength and durability for safely supporting multiple play participants 105. For example, plastic or PVC pipes, steel pipes, I-beams or channel beams, reinforced concrete beams/columns, and the like may all be used to form the supporting framework 102.

Figure 3:
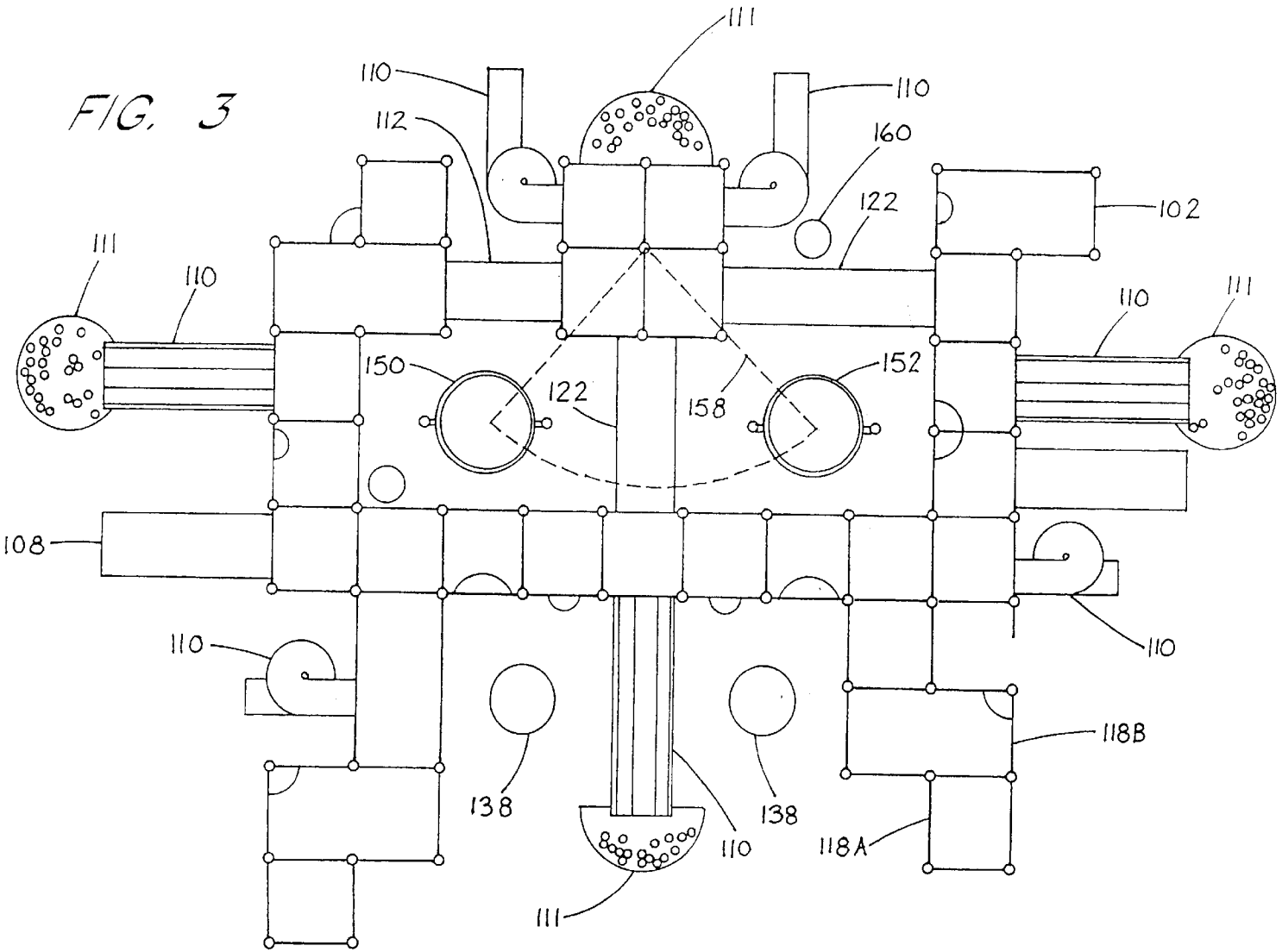
FIG. 3 is a schematic plan view of the interactive play structure of FIG. 1.
Figure 4:
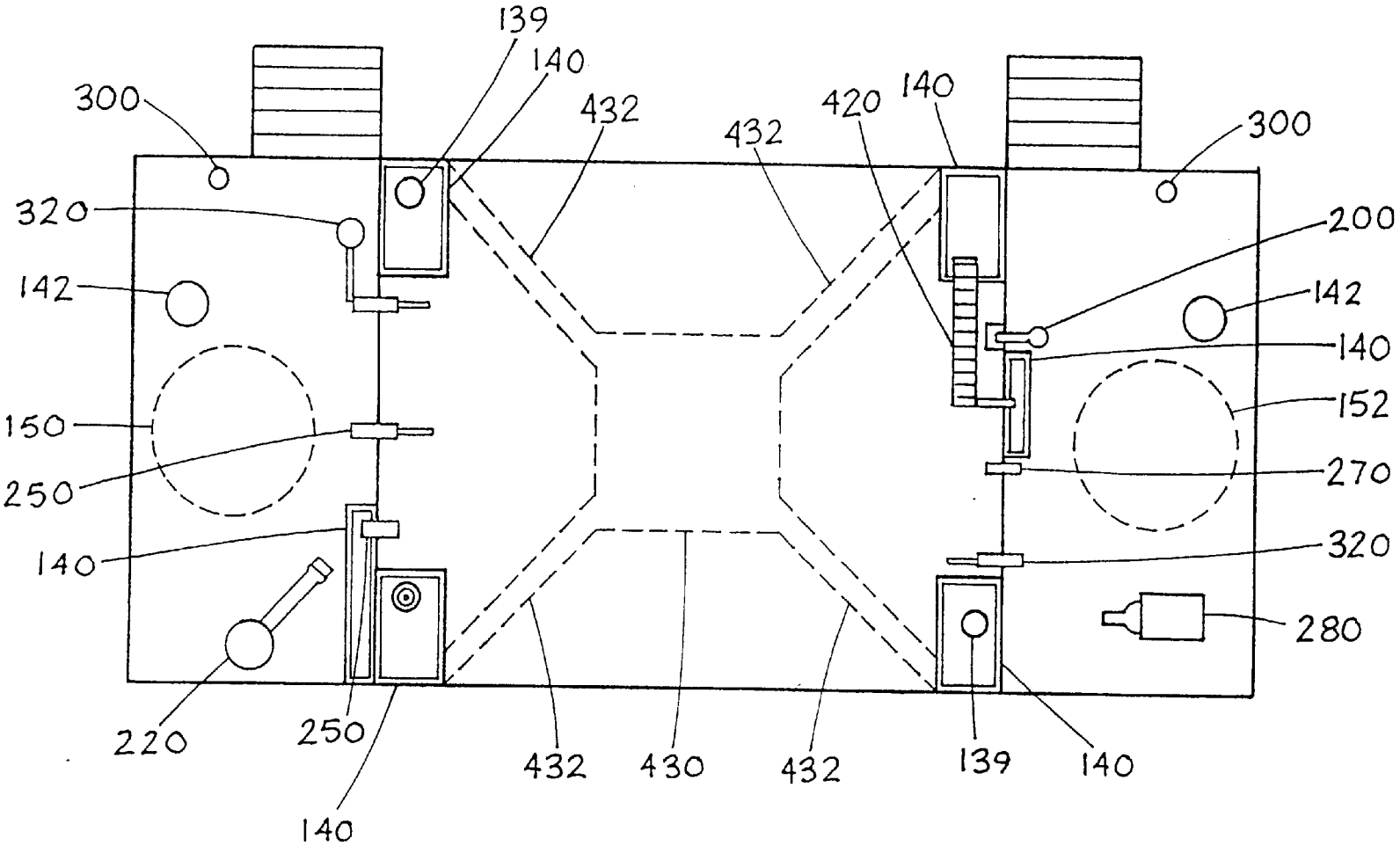
FIG. 4 is a detail plan view of the bucket-drop play zone of the interactive play structure of FIG. 1.
Figure 5:
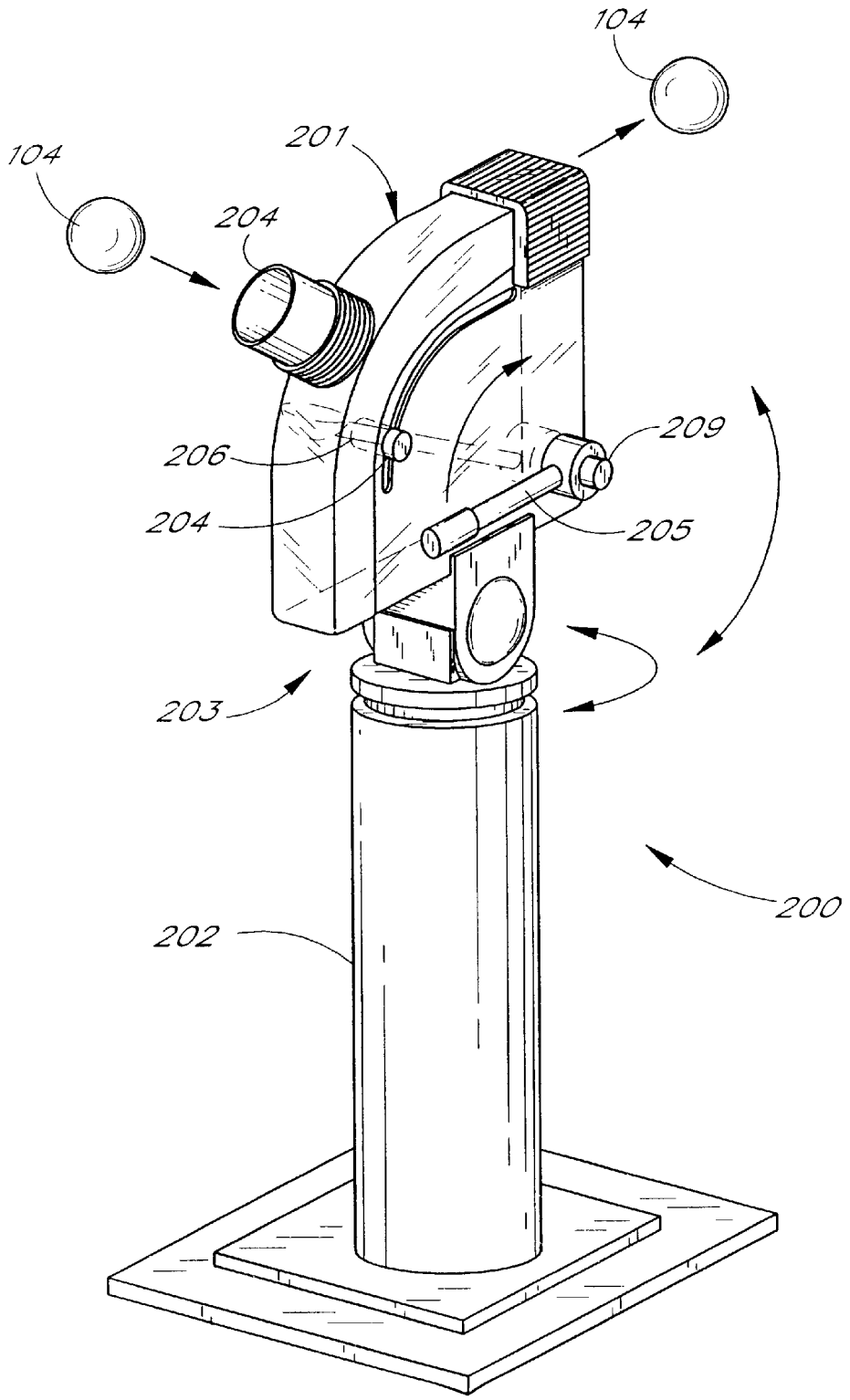
FIGS. 5–7 are perspective, side elevational and front elevational views, respectively, of a spring-loaded catapult accelerator having features of the present invention.
Figure 7:
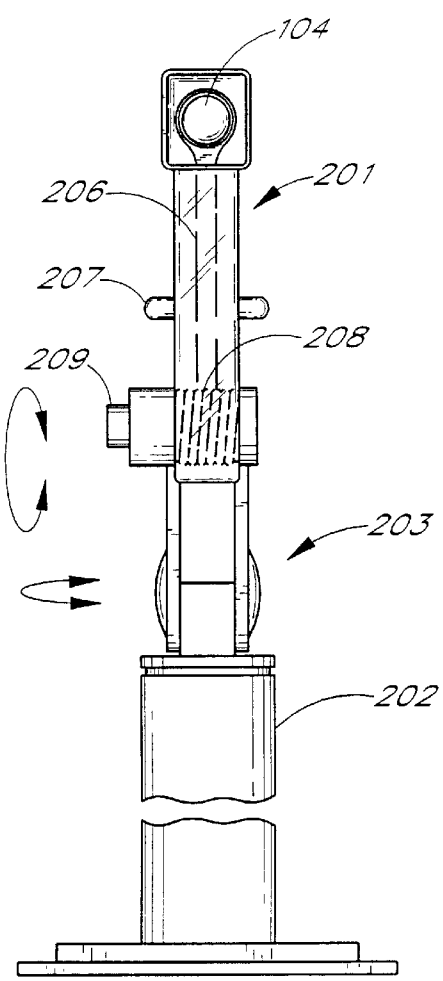
Figure 6:
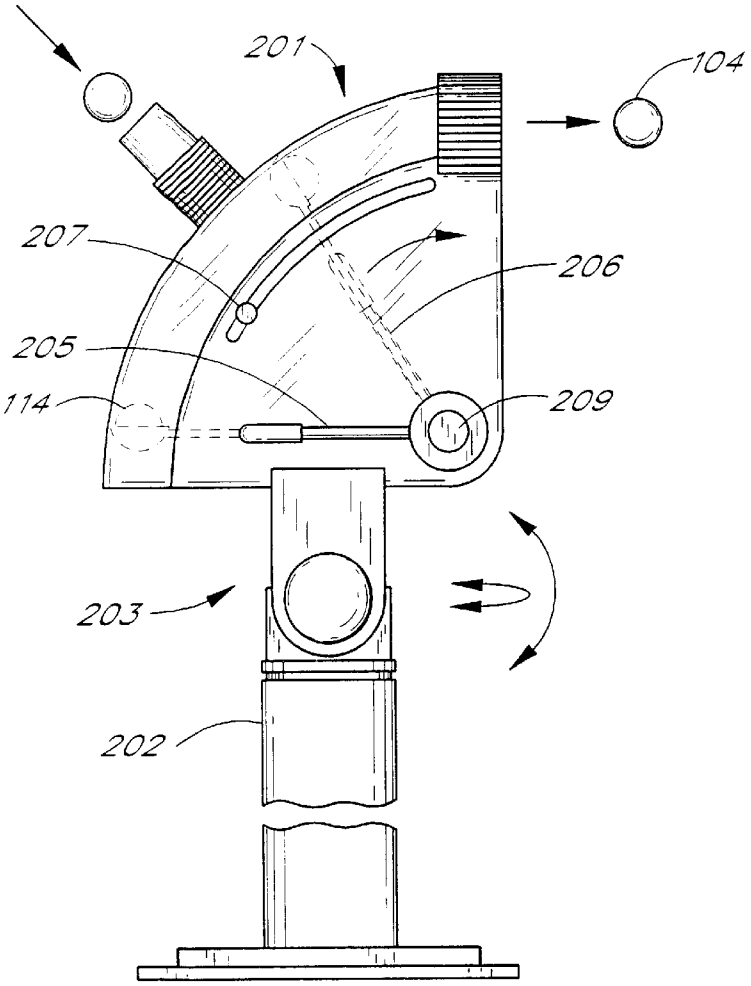

A number of modular platforms 118 are preferably supported between adjacent pylon or column members at various desired elevations with respect to ground level 116. defining various play areas. As best illustrated in FIG. 3, the platforms are preferably of similar shape and dimension such they can be assembled in a modular fashion, as shown. Mating 4'×4' square platforms 118*a* and 4'×8' rectangular platforms 118*b* are used in the preferred embodiment of FIGS. 1–4 for purposes of providing a modular construction. Alternatively, it is envisioned that any one of a number of other suitable modular or non-modular shapes and sizes may be used, including without limitation, triangles, pentagons, hexagons and/or trapezoids. Advantageously, the modular construction as taught herein allows a wide variety of play structures to be formed from a collection of standard support elements 126 and platforms 118 which may be interconnected on-site to create a play structure of virtually any desired shape, size, or height.

Adjacent platforms 118 are preferably staggered in elevation, as shown, such that play participants 105 can climb from one platform the next. Stairs 120, climbing nets 108, crawl tunnels 112, or swinging bridges 122 and/or slides 110 may also be provided to facilitate access to various elevated platforms 110 and play areas. Slides 110 originating from higher level platforms 118 of the play structure 100 can quickly bring play participants 105 down to lower levels. Optionally, one or more of the slides 110 may terminate in a ball pit 111, as shown, in order to increase excitement and protect play participants 105 from injury when exiting the slide 110.

For visual appeal and added safety, optional decorative panels, railings 132 and/or roofing elements 130 may be provided, as desired, to shade play participants 105 from the sun (for outdoor play structures), to prevent play participants from falling off the structure 100, or to complement a particular desired theme of the play structure 100. For instance, in the preferred embodiment shown in FIGS. 1 and 2, various roof elements 130 and railings 132 are provided for added safety and to complement the theme of a futuristic city. Decorative panels may be formed of wood, fiberglass or other reinforced fiber, PVC, aluminum, steel or a variety of other suitable materials, as desired. Corrosion-resistant materials are preferred if the play structure 100 is to be used outdoors. Of course, those skilled in the art will readily appreciate that a wide variety of other decorative or thematic elements may be incorporated into the overall design of the play structure 100 in order to provide added safety and/or to help convey a particular desired play theme.

Preferably, a number of conduits 124 are provided throughout the framework 102 for transporting play media to and from the various play areas in the play structure 100. The conduits 124 may be formed from plastic or PVC pipes joined together using commercially available fittings, as is well known in the art. Conduits 124 may also be formed from a wide variety of other suitable materials such as steel pipe, ceramic/clay pipe, or they may be formed as open channels and/or runners, as desired. Clear or colored/transpatent plastic pipes having an inner diameter of about 2⅛"–6½", and more preferably about 3–4", are particularly preferred for aesthetic appeal and added excitement. Alternatively, larger or smaller diameter conduits 124 or conduits 124 having different colors or shapes may be used, as desired, to accommodate various sizes and shapes of balls or other play media 104. In the particular embodiment shown, twisted flexible hose conduits 128 are used in various selected locations throughout the play structure 100 to help compliment the futuristic theme of the play structure 100 and to transport balls or other play media 104 between the various interconnected play areas. Play media 104 may be transported by use of pressurized air or other suitable means, as desired. Various participant-operated conveyors may also be employed to circulate balls or other play media 104 from one area of the structure 100 to another, as will be described in greater detail below.

While a particular preferred structure has been described, it will be readily apparent to those skilled in the art that a wide variety of other possible framing designs and construction techniques may be used to create the supporting framework 102 for an interactive play structure 100 while still enjoying the benefits and advantages of the present invention as taught herein. For instance, the supporting framework 102 may be constructed substantially entirely of molded or contoured concrete, fiberglass or plastic, as desired. Alternatively, the supporting framework may be constructed entirely or partially from conduits 124, which also transport play media to and from various locations throughout the play structure 100.

Interactive Play Media

The particular preferred embodiment shown in FIGS. 1 and 2 utilizes thousands of soft foam balls as an interactive play medium 104. These may be manipulated by play participants using various interactive play elements to create desired effects. Soft foam balls, commonly known as Nerf™ balls, are particularly preferred. These familiar balls are desirable for their texture and light weight as well as their attractiveness to young children who delight in handling them. Balls may range in size from approximately 1" to 12" in diameter or larger, as desired, and are preferable about 2½" in diameter. Preferably, the balls are not so small as to present a choking hazard for young children. The majority of the balls may be the same size, or a mixture of ball sizes may be utilized, as desired. A few play elements, as described below, may utilize balls of a relatively large diameter (about 12" or more). Certain play elements may use only certain sized balls, with filtering relays (not shown) in the conduits 124 permitting only certain sized balls to roll to certain play areas. A range of colors for the balls may also be used for visual appeal. Optionally, ball sizes and/or types may be color-coded as desired to indicate their use with particular play elements or in certain play zones and/or for facilitating their return to the proper areas when they are removed.

Other suitable play media 104 may include, without limitation, foam, plastic or rubber balls and similarly formed articles such as cubes, plates, discs, tubes, cones, rubber or foam bullets/arrows, the present invention not being limited to any particular preferred play media. These may be used alone or in combination with one another. For instance, flying discs, such as Frisbees™, may be flung from one location on the play structure 100 while other play participants shoot at the discs using foam balls or suction-cup arrows. Wet or semi-wet play mediums, such as slime-like materials, snow, mud, squirt guns and/or water balloons may also used, as desired, to cool and entertain play participants. Durable plastic or rubber play media are preferable in an outdoor play structure where environmental exposure may prematurely destroy or degrade the quality of certain play mediums such as foam balls.

Interactive Play Elements

Various interactive play elements are disposed in, on and/or around the play structure 100 to allow play participants 105 to create desired effects, as illustrated in FIGS. 1–4. These may include interactive elements such as projectile accelerators, cannons, interactive targets, fountains, geysers, cranes, filter relays, and the like for amusing and entertaining play participants and/or for producing various desired visual, aural or tactile effects.

Some interactive play elements may have immediate effects, while others may have delayed effects. Some play elements may produce local effects while others may produce remote effects. Each play participant 105, or sometimes a group of play participants working together, must experiment with the various play elements and associated actuators in order to discover which ones operated in which sequence will create the desired effect(s). Once one group figures it out, they can use the resulting play effect to surprise and entertain other play participants. Yet other play participants will observe the activity and will attempt to also figure it out in order to turn the tables on the next group. Repeated play on a particular play element can increase the participants' skills in accurately producing desired effects or increasing the size or range of such effects. Optionally, play participants can compete with one another using the various play elements to see which participant or group of participants can create bigger, longer, more accurate or more spectacular effects.

Beginning in the left-most foreground of FIG. 1, an interactive play element in the form of a geyser 138 is shown. The geyser 138 sprays a fountain of balls or other play media 104 into the air, scattering them about the play structure 100 and/or onto surrounding play participants 105. A conduit subterranean (not shown) may be used to feed play media 104 to the geyser 138 from beneath the ground level 116. Play media 104 may be sprayed either in a continuous or timed intermittent manner, as desired, or by direct or indirect activation by play participants.

Preferably, a recess or basin 166 surrounds the geyser 138 in order to collect the balls or other play media 104. For example, play media 104 may be collected and maintained in a sump basin (not shown) beneath the ground level 116. This may be periodically pressurized such that upon opening of a release valve, play media is shot upward under pressure. In an alternative embodiment, a series of pistons may be used to eject play media 104 positioned in corresponding cylinders. Again, the pistons may be timed or sequenced, as desired.

A flexible fire hose 170 and nozzle 136 provide another possible interactive play element which can be manipulated by a play participant 105 to selectively spray various play media 104 into the air or at other play participants 105. A spherical, preferably clear, plastic relay 172 acts as a trap and/or filter selectively feeding play media 104 into a pressurized tank 168. This tank, in turn, provides play media 104 under pressure to the flexible hose 170 and nozzle 136. Dramatic visual effects are created as multi-colored balls and/or other play media 104 bounce around the interior of the relay 172 and are sprayed out of the nozzle 136. The relay 172 may also be used to collect and/or filter play media 104 for further transmission along the various conduits 124, 128 or to other play elements or conveyors as desired.

An archimedes blaster 178 (right-most foreground of FIG. 1) provides yet another possible interactive play element, which play participants 105 can selectively activate to cause balls or other play media 104 to be conveyed upwardly along a vertical cylinder 180 and out through a nozzle 182 at the top. Balls or other play media 104 are forced up through the archimedes blaster 178 via suitable means such as pressurized air flowing along a spiral path upward to the nozzle 182. If desired, the blaster 178 may be configured such that play participants at higher levels of the play structure 100 can siphon off some or all of the play media 104 in the blaster 178 by manipulating various valves, gates or the like. Preferably the nozzle 182 is rotatable so that play participants 105 can selectively direct the nozzle 182 at various targets, other play participants 105 or the giant baskets 150, 152, as desired. Alternatively, the nozzle 182 may be pre-programmed to rotate at a predetermined speed, or it may be remotely controlled electro-mechanically by play participants 105.

Multiple order or delayed effects provide further challenge and excitement for play participants 105. For example, various projectile accelerators may be provided to allow play participants 105 to accelerate balls or other play media 104 from a basket or collection bin to impact a target or other unsuspecting play participants. Before an accelerator can be activated, however, it may first be necessary to provide the required "ammunition" by filling a corresponding basket or collection bin with balls or other play media 104 of a particular suited size and shape. This may be done, for instance, by gathering play media in a bucket or by operating an adjacent play element, such as a conveyor, to fill the collection bin. Alternatively, other play participants may form a bucket brigade or use a rope and pulley system to hoist balls or other play media 104 from a lower collection basin to fill the ammunition basket supplying the corresponding accelerator or other play elements.

Some play elements may provide "second order" effects in that they depend on at least one other play element to supply them with balls or other play media 104. Yet other play elements may provide "third order" effects in that their operation depends on two or more other play elements operated either simultaneously or in succession. Higher-order effects and/or various combinations of multiple-order and/or delayed effects may also be used to amuse and entertain play participants as desired. Those skilled in the art will appreciate that the number, variety and combination of multiple-order or delayed effects producible in accordance with the present invention is virtually unlimited.

Other interactive play elements may include, for example and without limitation, a pull-chain activated overhead reservoir for dumping balls or other play media 104 onto play participants, a tray or channel for allowing balls or other play media 104 to roll down onto a target or other play participants, a bucket conveyor for lifting balls or other play media 104 from a lower collection basin to an elevated container for supplying other play elements, and various interactive or projectile activated targets.

Giant Spilling Buckets

In the particular preferred embodiment shown in FIGS. 1–4 a pair of giant tipping buckets or baskets 150, 152 are balanced on top of the play structure 100, as shown. The giant tipping baskets 150, 152 are adapted to periodically spill thousands of foam balls or other play media 104 onto play participants 105 below, creating dramatic visual and tactile effects. Each basket 150, 152 is preferably about 25–100 feet tall and, more preferably, about 30 feet tall. Each basket is pivotably mounted on top of the play structure 100, as shown, and is adapted to tip over, periodically spilling a load of thousands of balls or other play media 104 onto play participants 105 below. One or both of the giant baskets 150, 152 may operate as a delayed effect, whereby play participants cooperate or compete to fill or empty the giant baskets, and thereby induce or prevent their spilling. Again, the possibilities for multiple order or delayed effects are virtually unlimited.

Each giant basket 150, 152 is pivotably mounted so as to be conditionally stable when empty or filled to less than fill capacity. In its stable condition, the pivot axis of each basket 150, 152 is above the combined center of gravity of each basket 150, 152 and the balls or other play media 104 contained in the basket. When the level in each basket reaches a certain predetermined point, however, the combined center of gravity of the basket and its contents becomes elevated above the pivot axis. This causes each basket 150, 152 to become unstable and to eventually spill. The conditions for stability and the direction of spilling can be controlled by selectively weighting each basket to slightly bias it forwards or backwards, as desired. Alternatively, each basket may be mounted slightly off-axis in order to bias it in a particular desired direction.

The particular shape of each basket 150, 152 may be varied, as desired, to accommodate different size play structures and to convey a particular play theme. The size and capacity of the baskets can also be varied, as desired, to achieve various desired effects having benefits and advantages as taught herein. A basket 150, 152 having a capacity of between about 500 and 5000 foam balls (2½"–4" dia.) should be adequate for most applications.

As illustrated in FIGS. 1 and 3, the baskets 150, 152 may be filled by balls or other play media 104 supplied by a pipe and spout 154 (left) or an archimedes screw conveyor 160 (right). Depending upon the desired effect, this flow of play media 104 may either be passive-continuous, passive-intermittent, or partially or fully active (i.e., controlled by play participants). For passive-continuous flow, the basket fills up and spills over at fairly regular intervals. Alternatively, play media 104 filling the basket may be intermittent or random such that spilling of the giant baskets 150, 152 occurs at unpredictable intervals.

The baskets 150, 152 may optionally be filled or emptied using a giant scoop 156 mounted on a crane 158. The crane 158 is selectively controlled by one or more play participants 105 to position the scoop 156 over a sump 430 (FIG. 4) or other source of play media 104. The scoop 156 may be manipulated to pick up a load of balls or other play media 104 and deliver them to either basket 150, 152. To accommodate such operation, the scoop 156 and crane 158 are preferably capable of lateral and vertical motion using motors and controls such as are well known to those skilled in the art. Alternatively, one or more rope-and-pulley bucket lifts 142 (FIG. 4) may be used to help fill or empty one or both of the baskets 150, 152, as desired.

When the baskets tip, the balls or other play media 104 contained in the baskets 150, 152 preferably falls onto deflection shields 162, as shown in FIG. 1. This causes the play media 104 to bounce and disperse widely, creating dramatic visual and aural effects. The presence of the shields 162 also mitigates the direct impact of play media 104 on play participants 105. The size and shape of the deflection shields 162, the angle of orientation, and the particular materials used to construct the deflection shields may be varied to create particular desired effects. Sheet metal awnings have been found to provide adequate results for most applications.

One or more optional openings 164 may be provided in the deflection shields 162, as shown, for allowing at least a portion of the spilling play media 104 to directly impact play participants 105 standing on a platform immediately below the opening. Such openings 164 may either be fixed in size or they may be adjustable via a sliding door or similar device well known in the art. Preferably, the openings 164 are of sufficient size and shape to allow significant amounts of play media 104 to enter and bounce about the play structure 100, but not so large as to allow injury to play participants 105. A single round opening 164 having an open area of between about 2–8 square feet provides an adequate compromise for most applications. Of course, larger or smaller openings having various other shapes and sizes may also be used, as desired. Optional baffles (not shown) may also be provided in the path of the spilling play media through the opening 164 in order to mitigate the direct impact of such articles on play participants standing immediately below the opening.

Accelerators

The following table is provided for convenience in identifying the various elements of the invention as shown and described in connection with FIGS. 5–28:

TABLE 2

| Ref. | Description |
|---|---|
| 200 | Spring-Catapult |
| 201 | Housing |
| 202 | Pedestal |
| 203 | Swivel Base |
| 204 | Loading Tube |
| 205 | Lever Arm |
| 206 | Catapult Arm |
| 207 | Stop Bar |
| 208 | Coil Spring |
| 209 | Shaft |
| 214 | Spring |
| 220 | Counterweight Catapult |
| 211 | Support Bar |
| 212 | Catapult Arm |
| 213 | Cup |
| 216 | Counterweight |
| 217 | Threaded Portion |
| 218 | Pivot Shaft |
| 220 | Basket Catapult |
| 221 | Basket |
| 222 | Counterweight |
| 223 | Threaded Portion |
| 224 | Catapult Arm |
| 225 | Swivel Base |
| 226 | Pivot Shaft |
| 228 | Bearings |
| 230 | Crossbow |
| 231 | Housing |
| 232 | Resilient Band |
| 233 | Support Bar |
| 234 | Handle |
| 235 | Trigger |
| 236 | Loading Tube |
| 237 | Cock Mechanism |
| 240, 250 | Flywheel Accelerators |
| 241 | Wheel Crank |
| 242 | Conductor |
| 243 | Housing |
| 244, 252 | Flywheels |
| 245 | Barrel |
| 246 | Basket |
| 247 | Loading Tube |
| 253 | Base |
| 254 | Gear Shifter |
| 255 | Handle |
| 256 | Barrel |
| 257 | Hand Crank |
| 258 | Cable Actuator |
| 259 | Gear Housing |
| 260 | Chain |
| 261 | Derailleur |
| 262 | Gunsight |
| 270 | Plunger Accelerator |
| 271 | Basket |
| 272 | Barrel |
| 273 | Control Gate |
| 274 | Loading Tube |
| 276 | Plunger |
| 277 | Spring |
| 278 | Plunger Shaft |
| 279 | Handle |
| 280 | Cannon |
| 281 | Air Bladder |
| 282 | Pneumatic Hose |

TABLE 2-continued

| Ref. | Description |
|---|---|
| 283 | Barrel |
| 284 | Swivel Base |
| | Pump, Guns |
| 291 | Trigger |
| 292 | Gun Barrel |
| 293 | Loading Tube |
| 294 | Handle |
| 295 | Pistons |
| 296 | Cylinders |
| 297 | Flex. Tubes |
| 298 | Charge Reservoir |
| 299 | Foot Pump |
| 301 | Loading Funnel |
| 302 | Gun Barrel |
| 303 | Bellows |
| 304 | Handle |
| 312 | Twin Barrels |
| 313 | O-Ring |
| 314 | Compression Chamber |
| 315 | Pistons |
| 316 | Piston Handle |
| 321 | Pneumatic Gun |
| 322 | Barrel |
| 323 | Loading Basket |
| 324 | Supply Conduit |
| 325 | Pneumatic Hose |
| 326 | Feed Line |
| 327 | Actuator Switch |
| 328 | PLC |

Various projectile accelerators, such as guns, cross-bows, catapults and canons, provide particularly exciting interactive play elements in accordance with the present invention. Several preferred embodiments of such interactive accelerators are described below by way of example only. Those skilled in the art will readily appreciated that a wide variety of other accelerator devices are possible and desirable for producing the benefits and advantages in accordance with the present invention.

Referring to FIGS. 5–11, three types of catapult accelerators are shown, generally corresponding to spring-loaded catapults 200, 210 and counterweight catapults 220, 220', respectively. The spring-loaded catapult 200 of FIGS. 5–7 may either be mounted to a rail 132 of the play structure 100 (FIGS. 1, 2) or to a pedestal 202, as shown. A housing 201, preferably formed of acrylic or other suitable material, is adapted to tilt and swivel about a base 203. A loading tube 204 on the top of the housing 201 allows a play participant to load the catapult 200 with balls or other suitable play media 104.

A lever arm 205 is provided, as shown, and is adapted to be ratcheted back to cock a catapult arm 206 against a torsion spring 208. The lever arm 205 is joined to the catapult arm 206 by a common shaft 209 around which the torsion spring 208 is disposed. An adjustable force regulator is provided, as shown, comprising a stop bar 207 slidably fixed along an adjustment slot. The stop bar 207 determines the maximum cocking angle of the catapult arm 206. This may be provided for purposes of safety and/or to allow calibration of the catapult by play participants for increased accuracy, as desired. The catapult 200 is operated by loading one or more balls or other play media 104 into the loading tube 204, pulling back the lever arm 205 and then releasing the lever arm 205 to propel the ball or other play media 104 in a desired direction.

If desired, an optional ammunition clip (not shown) may be provided comprising an extended tube adapted to hold several balls or other play media 104. This may be selectively attached to the loading tube 204, as desired, so that reloading and launching may be performed in rapid succession by play participants 105. A sliding tab or the like may be mounted on the clip at the entry into the catapult to control the delivery of each ball or other play media into the housing 201 of the catapult 200, as needed. In a first position, for instance, the tab may obstruct the flow of balls or other play media 104 into the catapult housing 201. In a second position the tab may allow balls or other play media 104 to fall into place in the catapult housing 201. Alternatively, a wide variety of other methods and devices may be used to supply balls or other play media 104 to the catapult 200 as will be apparent to those skilled in the art.

Figure 8:
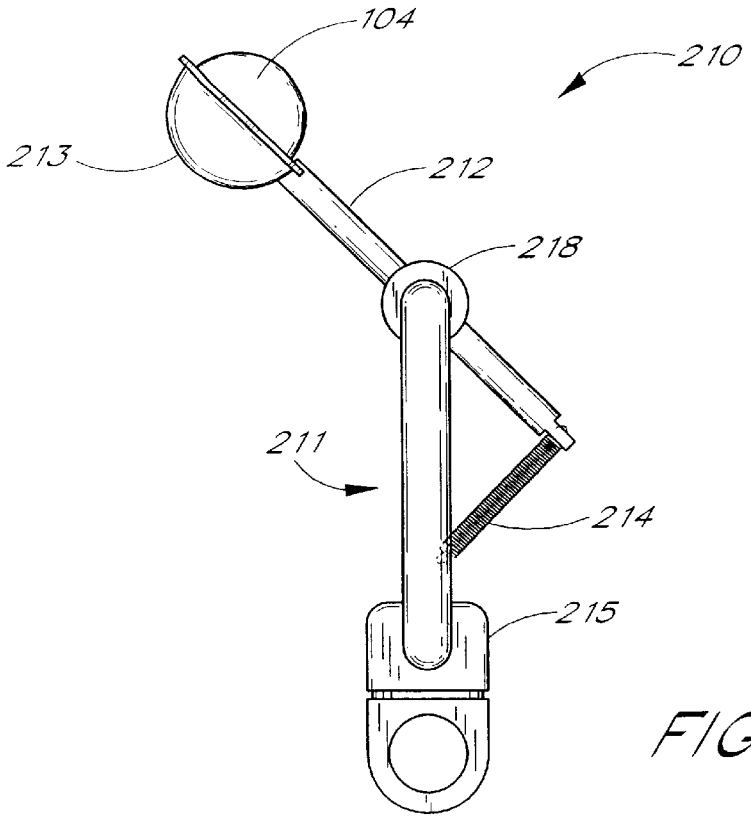
FIG. 8 is a side elevational view of an alternative embodiment of a spring-loaded catapult accelerator having features of the present invention.

FIG. 8 illustrates an alternative embodiment of a spring-loaded catapult 210 particularly adapted for rail-mounting. A U-shaped bar 211 serves as a fulcrum about which the catapult arm 212 is pivoted. A cup 213 on the upper end of the arm 212 holds a ball or other play media 104 to be flung or catapulted. A tension spring 214 is secured to the other end of the arm 212 to facilitate energy storage and release for operating the catapult 210.

Figure 9:
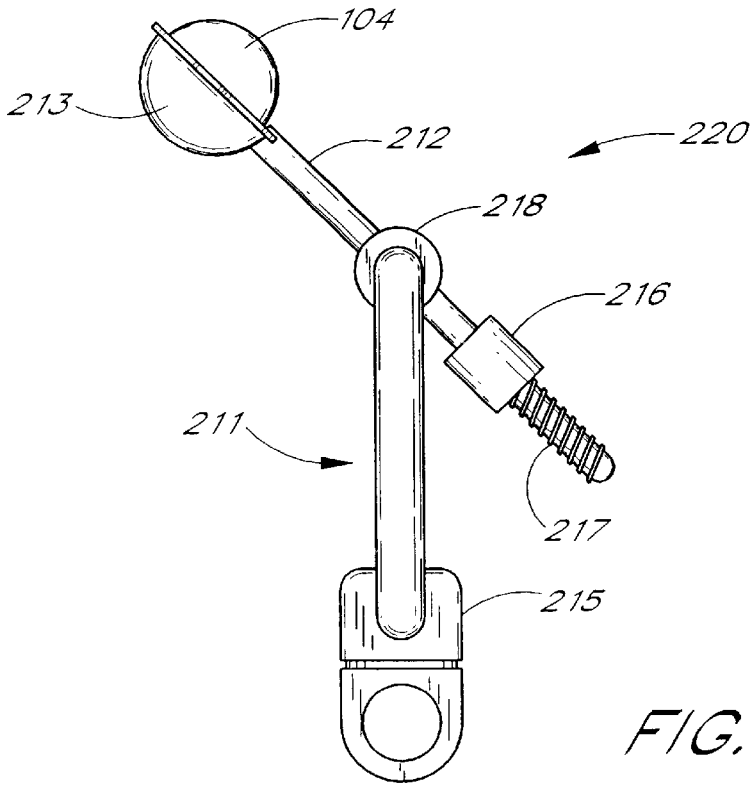
FIGS. 9 and 10 are side elevational and perspective views, respectively, of a counterweight catapult accelerator having features of the present invention.
Figure 10:
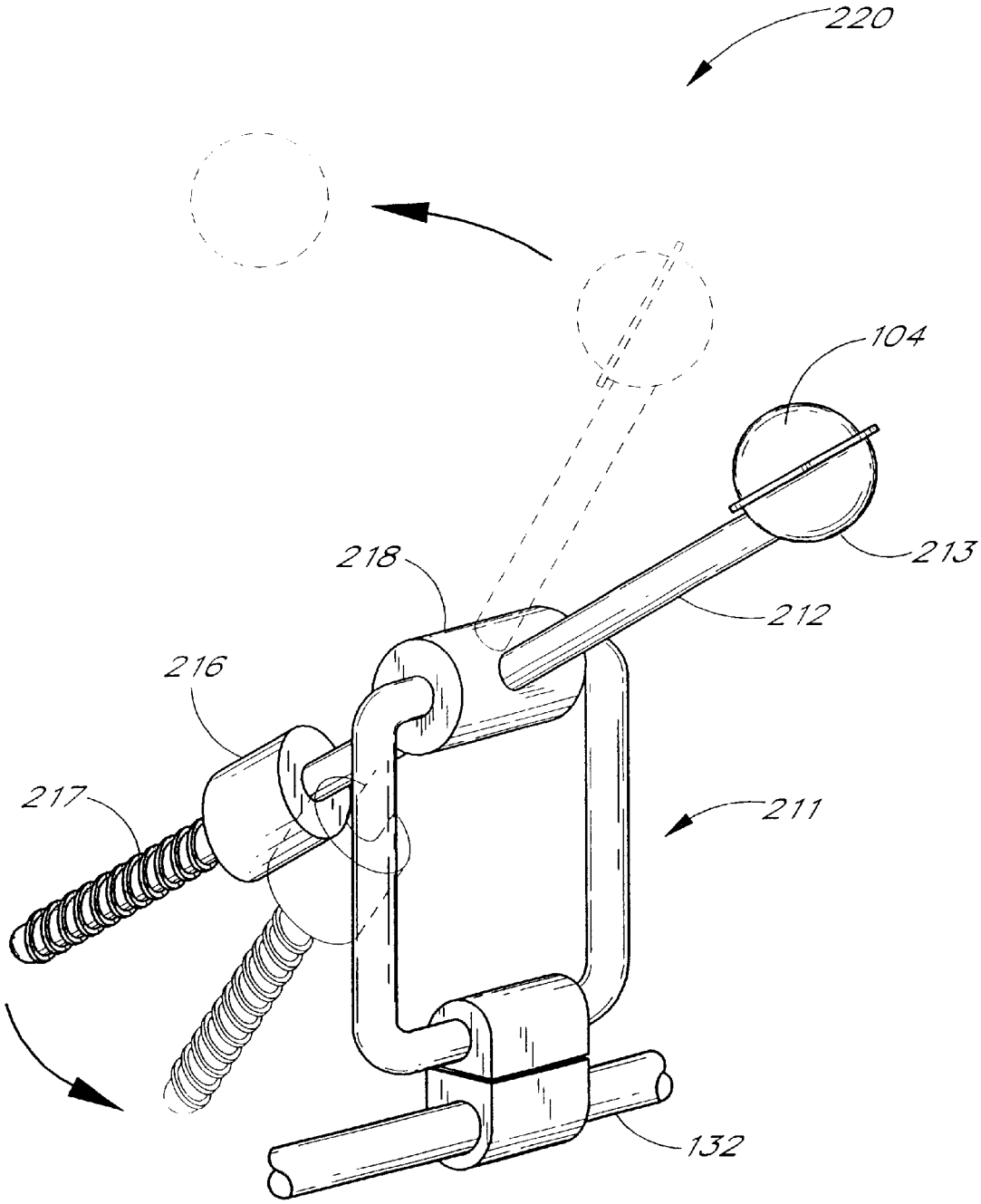
Figure 11:
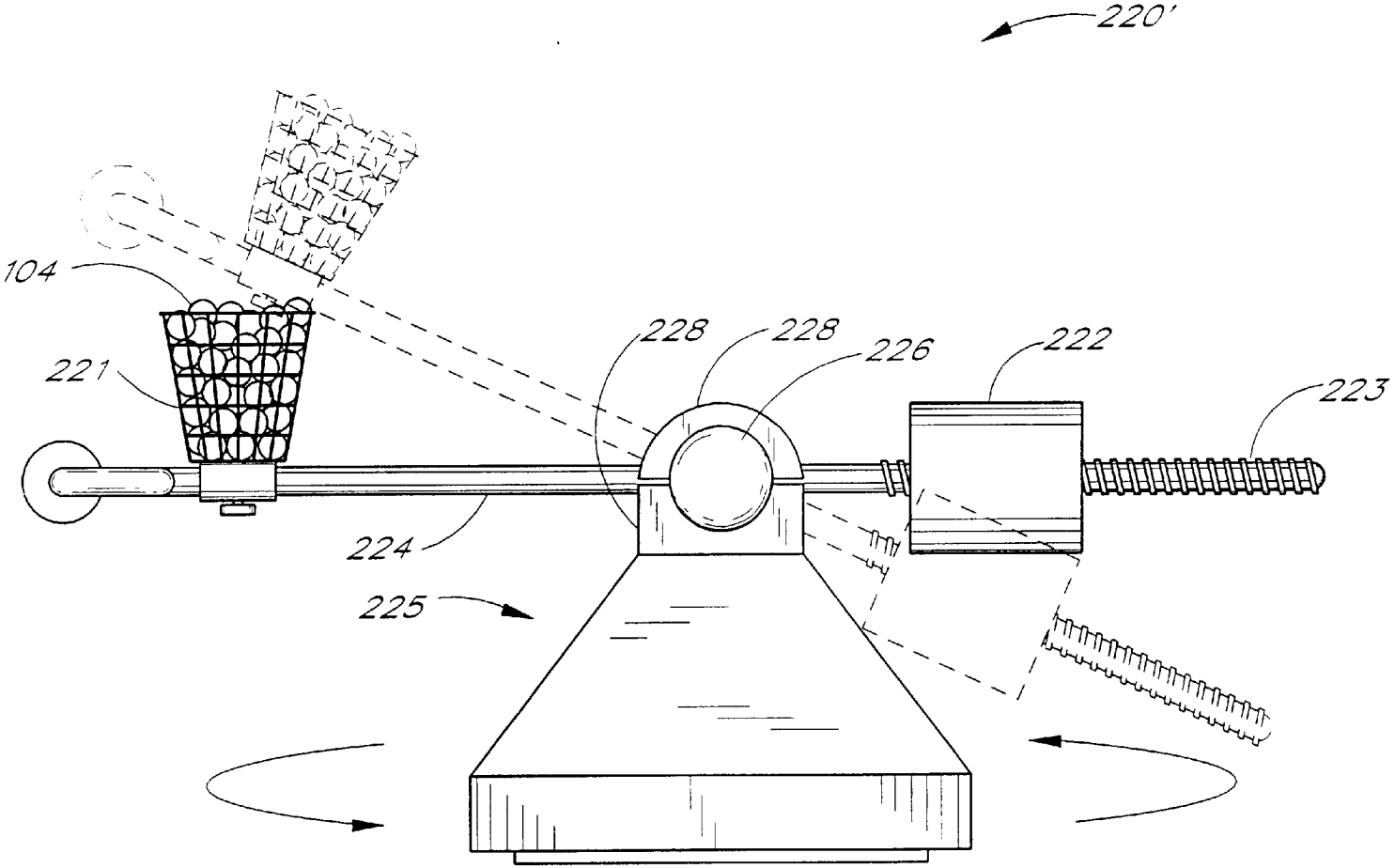
FIG. 11 is a side elevational view of an alternative embodiment of a counterweight catapult accelerator having features of the present invention.

FIGS. 9 and 10 show a possible variation of the catapult of FIG. 10 wherein a counterweight 216 is mounted on a threaded portion 217 of the lower end of the arm 212 to provide energy storage and release for operating the catapult. When the cupped end of the arm is cocked and released by the play participant 105, gravity acting on the counterweight 216 on the other end of the arm causes the lighter cup end 213 to rotate about the shaft 211 via a bearing 218. The play media 104 is released when the arm 212 reaches the end of its travel at a nearly vertical position, as shown. Another alternative embodiment of a counterweight catapult 220' is shown in FIG. 11 and includes a basket 221 capable of holding a plurality of balls or other play media 104 of either uniform or mixed sizes. Like the smaller counterweight catapult 220 illustrated in FIGS. 9 and 10, the catapult 220' has a movable counterweight 222 mounted on a threaded portion 223 of the catapult arm 224. Preferably, the counterweight 222 is formed from a dense material such as lead or steel in order to provide sufficient weight to store and release energy. A pedestal base 225 of the catapult is preferably adapted to be rotatable in the horizontal plane in accordance with conventional swivel designs so that the catapult may be aimed in any desired direction. The arm 224 is mounted on a shaft 226 pivotably supported by bearings 228. Alternatively, play participants may use their own weight to propel play media 104 by jumping on one end of a catapult arm.

Figure 12:
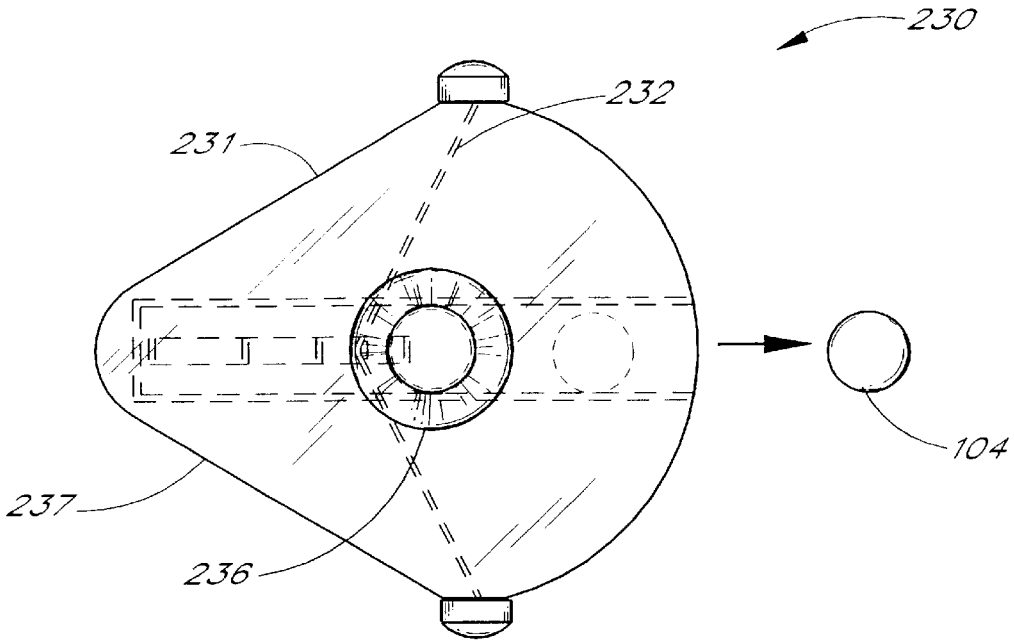
FIGS. 12 and 13 are top plan and side elevational views, respectively, of a crossbow accelerator having features of the present invention.
Figure 13:
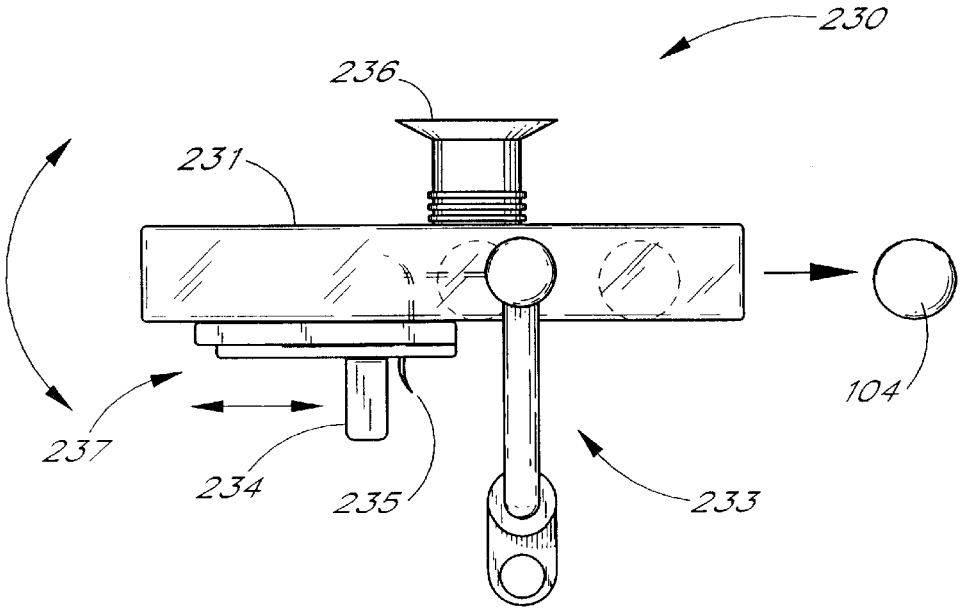

FIGS. 12 and 13 show a crossbow or slingshot accelerator 230. The crossbow 230 comprises a housing 231 within which a resilient band 232 is disposed, as shown. The housing 231 is preferably formed of a translucent plastic material such as acrylic so that the inner workings of the device may be viewed by play participants. The resilient band 232 may be any type of suitable elastic or rubber band such as the type available under the name "Bungees." The entire assembly is preferably mounted on a rotatable support 233 secured to a rail or other portion of the play structure, as desired.

To load the crossbow 230, a ball or other play media 104 is fed into a loading chamber 236 provided on the top of the housing 231. The resilient band 232 is stretched in a horizontal plane using a suitable cocking mechanism 237. For example, a sliding handle 234 may be pulled back to cock the crossbow 230. Once cocked, the trigger 235 may be depressed to release the band 232, accelerating the ball or other play media 104 as the elastic band 232 contracts to its original shape.

Figure 14A:
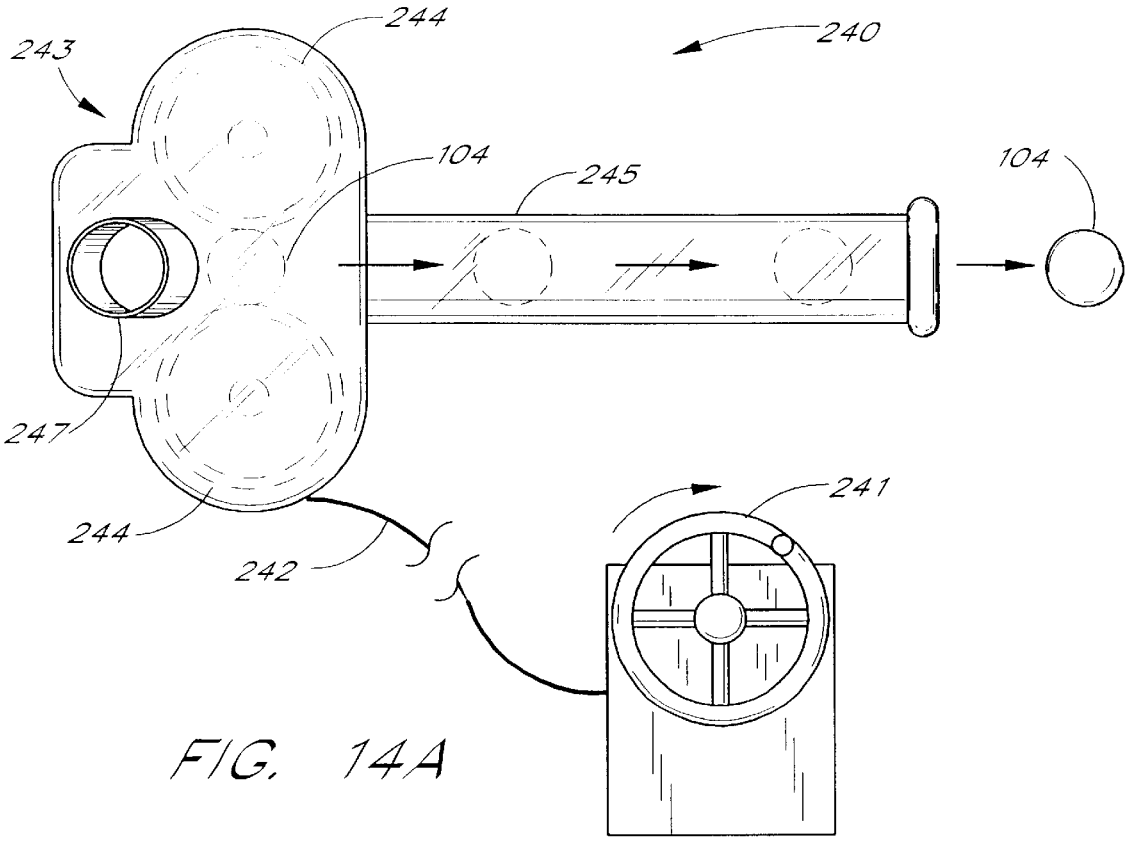
FIGS. 14A and 14B are top plan and side elevational views, respectively, of a flywheel accelerator having features in accordance with the present invention.
Figure 14B:
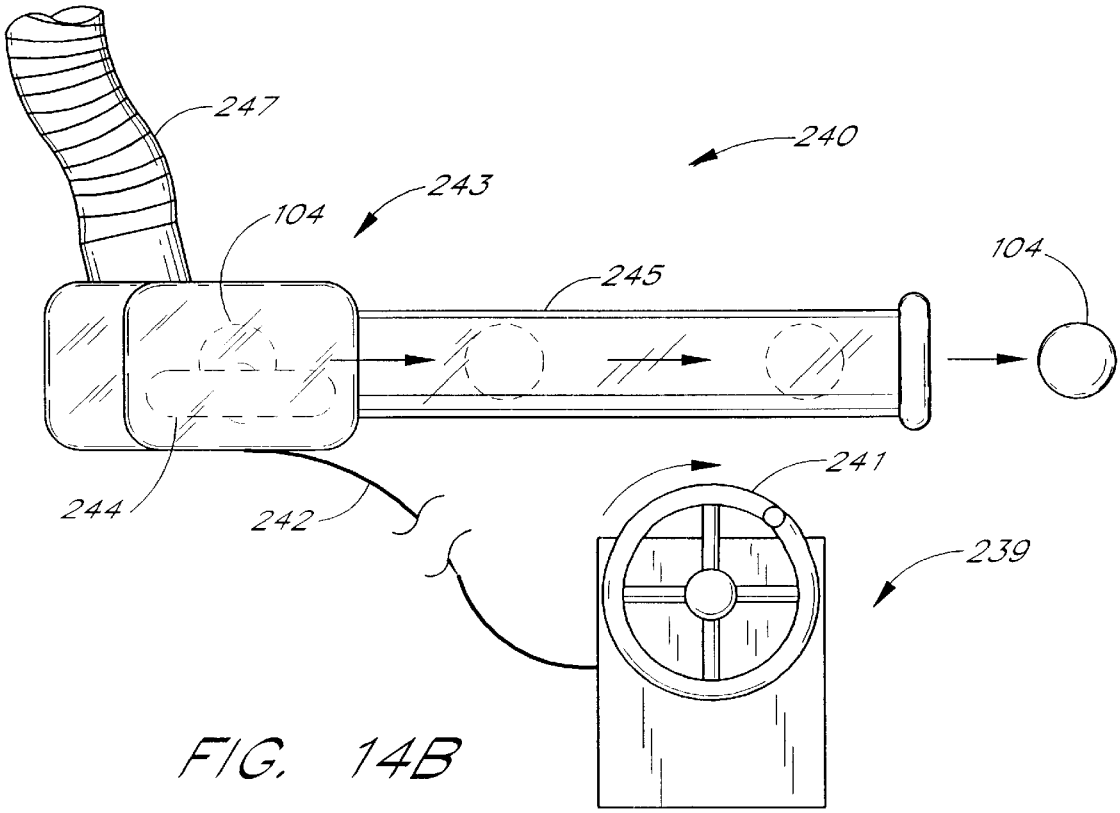

FIGS. 14A and 14B show an alternative embodiment of an interactive accelerator provided in the form of a flywheel accelerator 240. In this embodiment, a generator 239 is actuated by one play participant by turning a wheel crank 241. The generator 239 is connected by electrical cables or a pneumatic conduit 242 to a corresponding electric or pneumatic motor (not shown) located within the housing 243. The motor turns a pair of opposed flywheels 244 at one end of the housing 243. The flywheels 244 are separated by a distance approximately equal to or slightly smaller than the diameter of the play media 104 such that as the play media 104 enters the gap, the flywheels 244 propel the play media down the barrel 245 of the flywheel accelerator 240 and out the end thereof, as shown.

Figure 15:
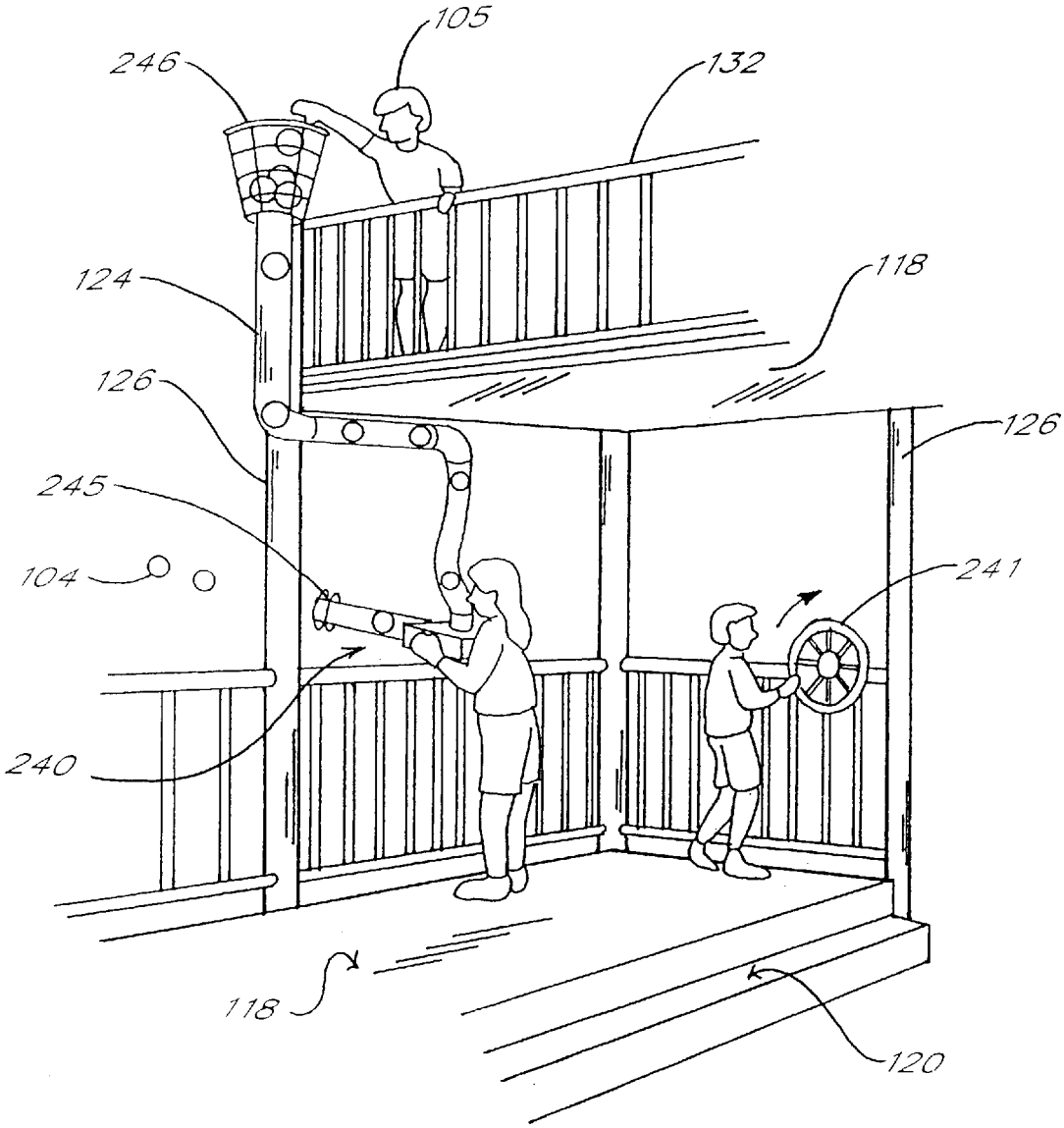
FIG. 15 is a perspective view of the flywheel accelerator of FIGS. 14A and 14B, showing one possible mode of operation by multiple play participants.

In accordance with a particularly preferred embodiment of the invention, any of the above-described accelerators or other interactive play elements may require the cooperative efforts of multiple play participants at multiple locations and/or levels of the play structure to produce a desired play effect. For example, as shown in FIG. 15, a play participant 105 at a distant location or elevation may load play media 104 into a basket 246 or other receptacle. This may be connected by a conduit 124 to a loading tube 247 in order to provide ammunition to the flywheel accelerator 240. Another play participant 105 cranks the wheel 241 to generate power to run the accelerator 240. Yet a third play participant aims and fires the accelerator 240 by actuating a suitable trigger device. In this manner, multi-level interactive play is attained. Alternatively, an overhead hopper (not shown) may be used to collect play media 104 for use in the flywheel accelerator 240. The hopper may be fed by various conduits or conveyor systems of the play structure 100, the hopper having an outlet for supplying play media to the basket 246 and/or other interactive play elements, as desired.

Figure 17:
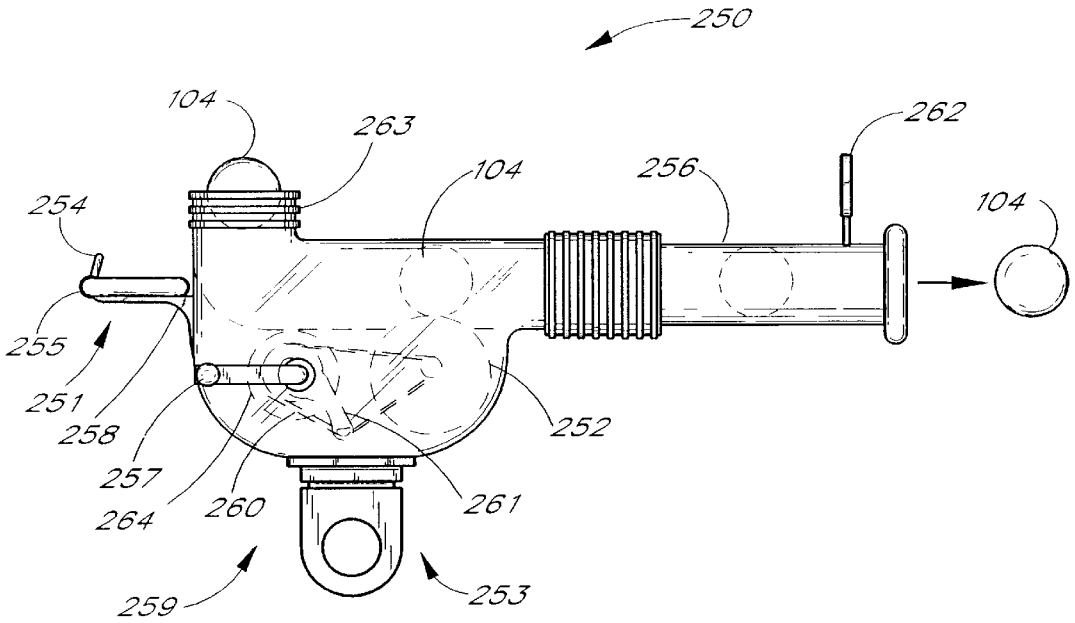
FIGS. 16 and 17 are top plan and side elevational views, respectively, of a flywheel accelerator having features of the present invention.
Figure 16:
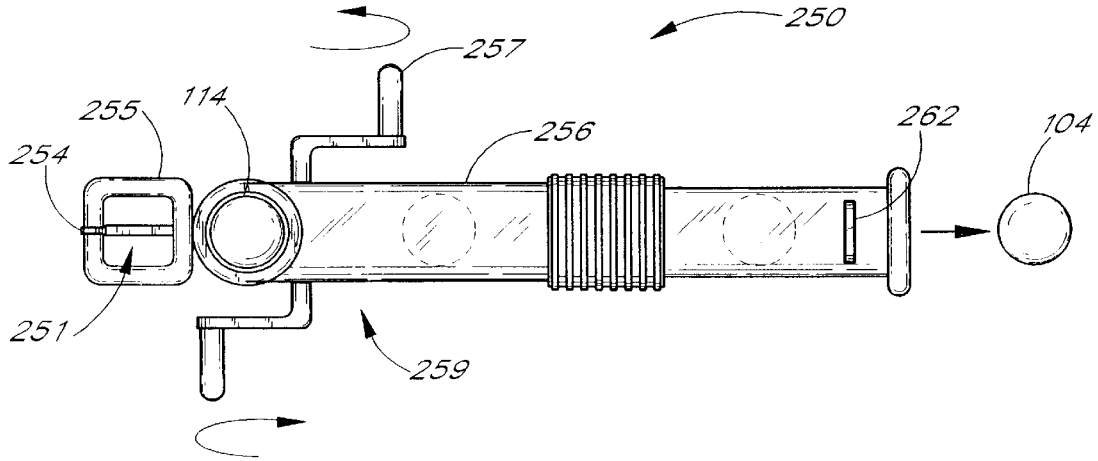

Another type of flywheel accelerator 250 is shown in FIGS. 16 and 17. The flywheel accelerator 250 generally comprises a housing 259 mounted to a base 253 which is adapted to be pivotably mounted to a rail of the play structure. A flywheel 252 is disposed within the housing for propelling play media 104. Play participants provide energy to the flywheel 252 by turning a hand crank 257 which turns a drive-gear cluster 264 which, in turn, drives the flywheel 252 using a drive chain or belt. A bicycle-type derailleur 261 is provided for allowing play participants to change the gear ratio between the hand crank 257 and the flywheel 252 in order to attain a range of desired flywheel speeds. A corresponding gear shifter 254 is mounted on a handle 255 at a proximal end of the housing 259 and is operatively connected via a cable actuator 258 to the derailleur 261 in order to allow play participants to shift between gears as desired.

In operation, balls or other play media 104 are fed into the loading chamber 263. The housing 259 is formed such that the balls or play media 104 are guided into the barrel 256 adjacent the flywheel 252. As the ball or other play media 104 enters the barrel 256, the flywheel 252 engages the play media 104 propelling it down the barrel 256. Play participants can control the velocity and acceleration of play media by selectively controlling the speed of the flywheel 252. An optional gunsight 262 provides an aiming mechanism for increasing the accuracy of the flywheel accelerator 250.

Figure 18:
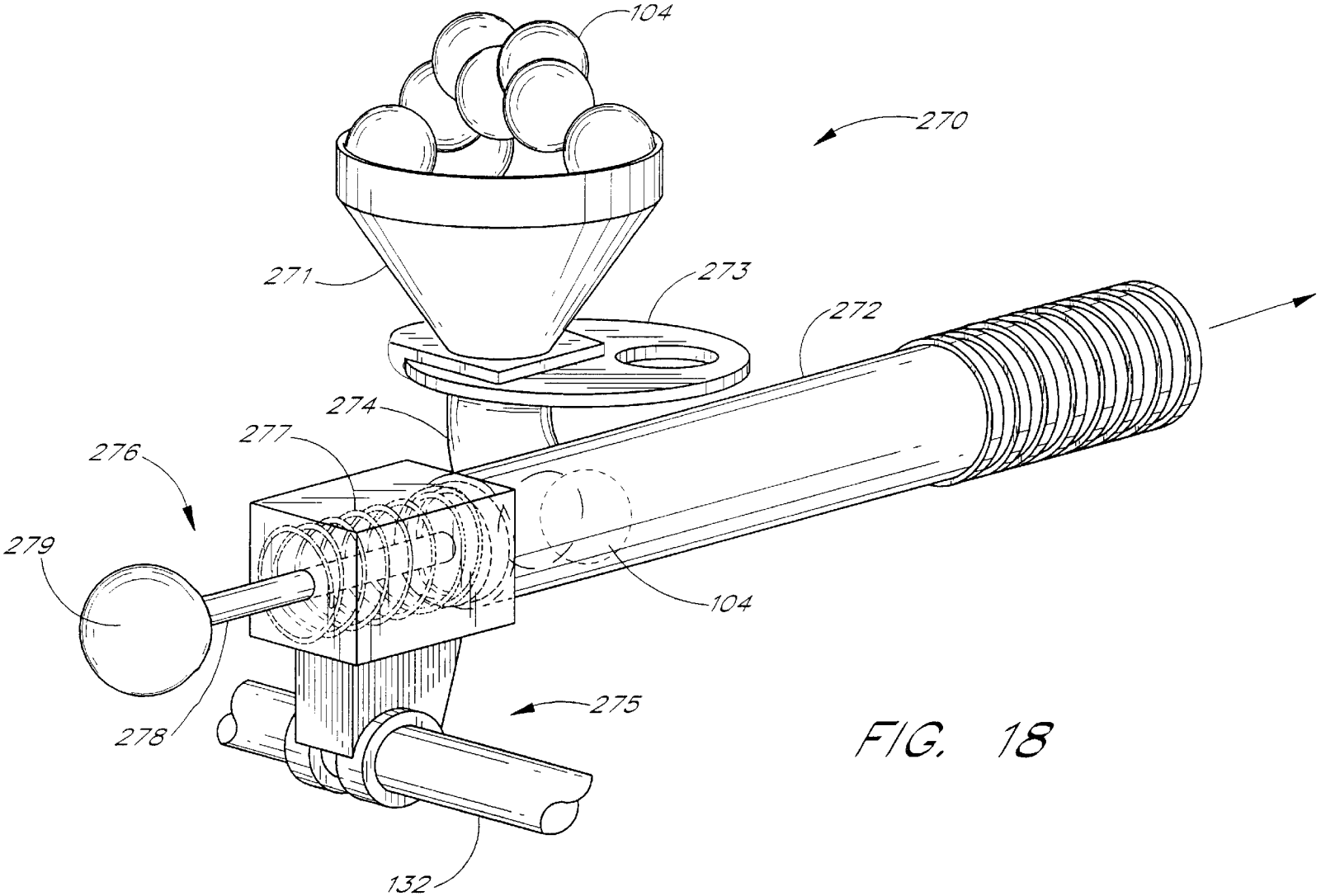
FIGS. 18–20 are perspective, side elevational and rear elevational views, respectively, of a spring-loaded plunger accelerator having features of the present invention.
Figure 19:
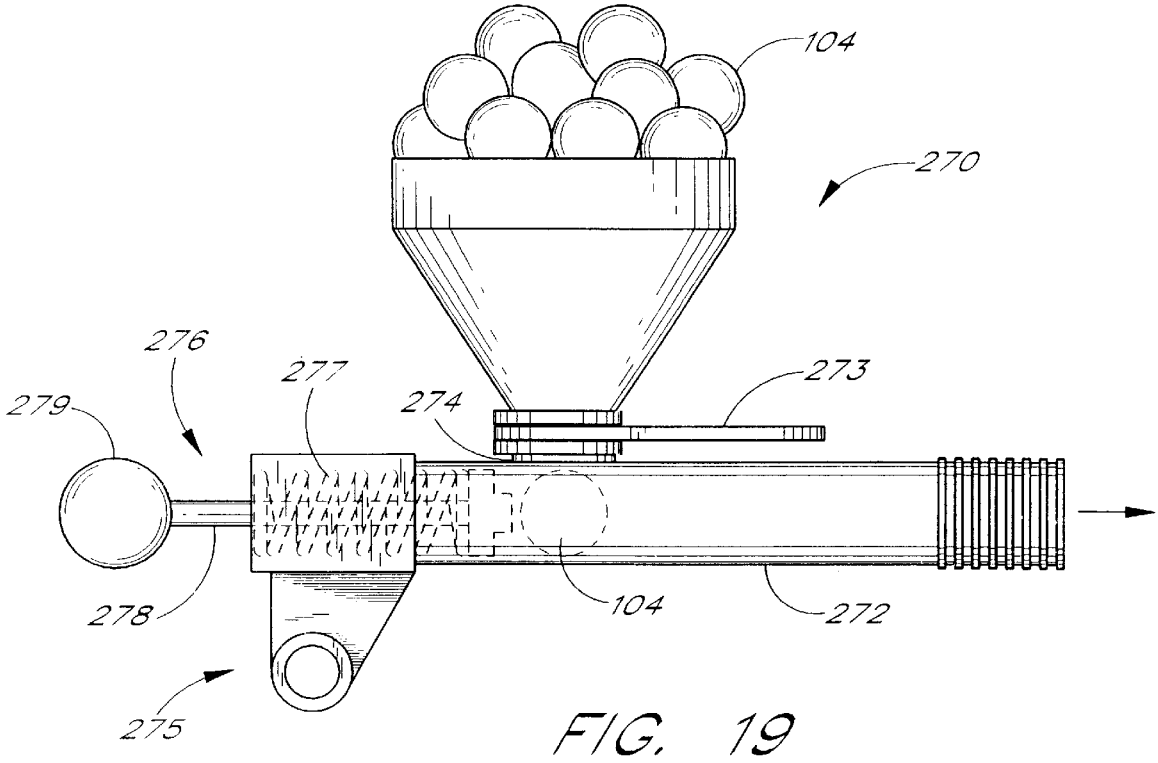
Figure 20:
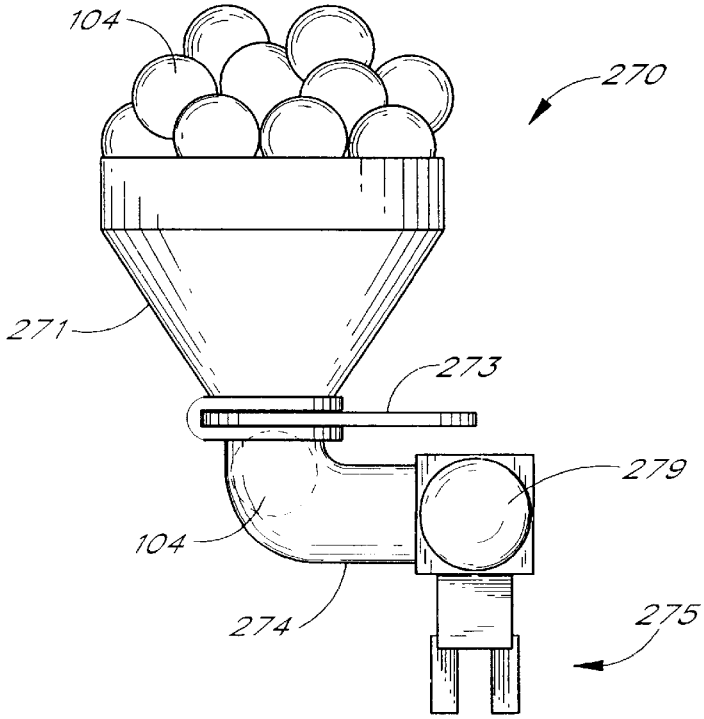

FIGS. 18–20 show a plunger-type accelerator 270. The accelerator 270 generally comprises a barrel 272, preferably of a suitable translucent material such as acrylic, and a spring-loaded plunger 276. The plunger 276 has a distal end which is positioned near the entrance of the barrel 272. A spring 277 is positioned around a shaft 278 of the plunger 276, as shown. The plunger shaft 278 has a handle 279 on one end which is positioned outside the barrel 272. A play participant pulls on the handle 279 to compress the spring 277. When the handle 279 is released, the spring 277 expands, causing the plunger 276 to impact the ball or other play media 104 in the barrel 272 propelling it out the barrel 272.

The accelerator 270 may be pedestal-mounted or rail-mounted as desired. A basket 271 is preferably provided for holding balls or other play media 104 to be fed into the accelerator 270. The basket 271 is preferably mounted above the barrel 272 and to one side so that the balls or play media fall into the barrel 272 and the basket 271 does not obscure the line of sight of a play participant operating the accelerator 270. A rotatable disk 273 may be provided, as shown, having at least one opening for selectively admitting balls or other play media 104 into the loading tube 274 of the accelerator 270.

Figure 21:
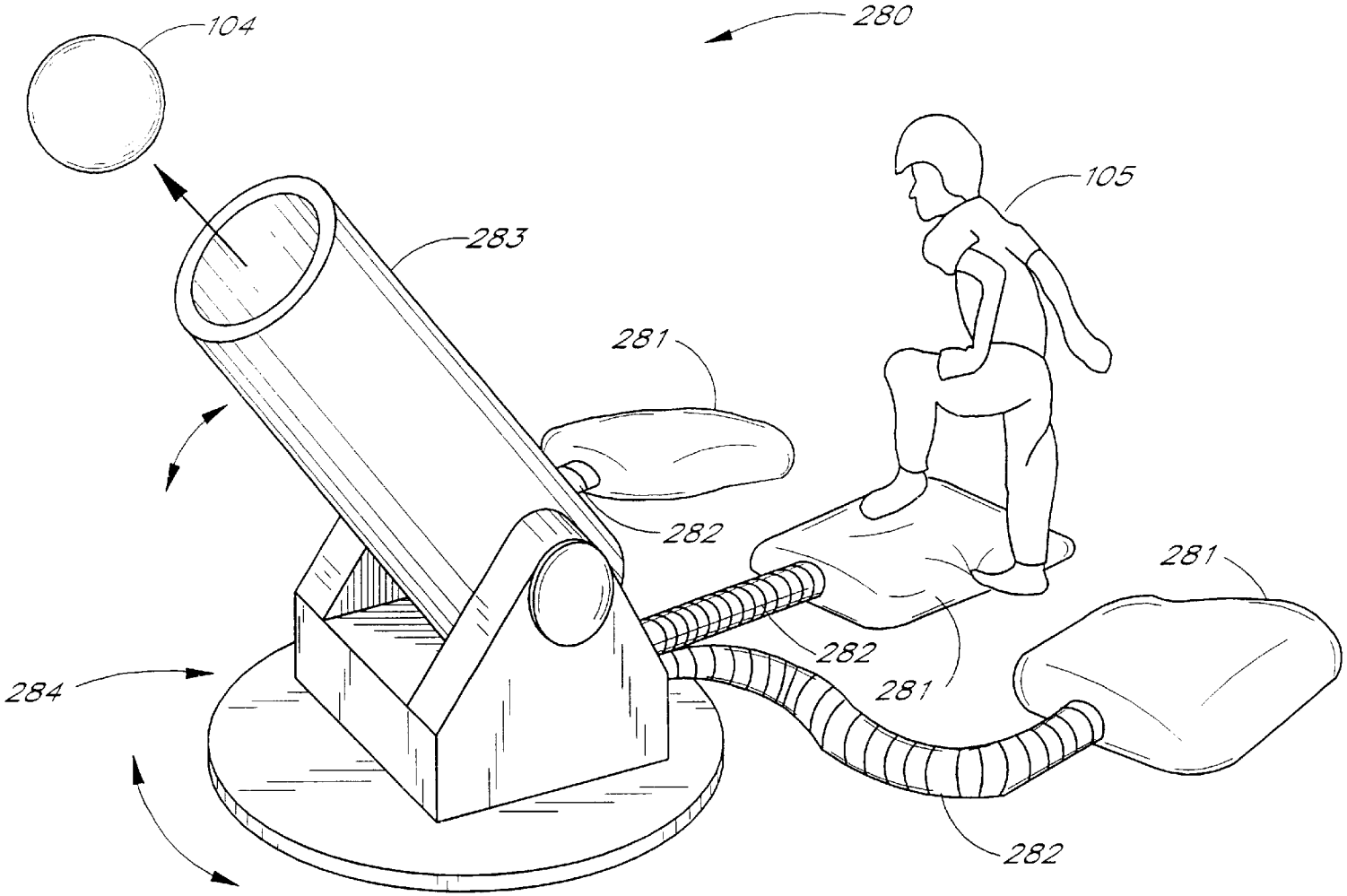
FIG. 21 is a perspective view of a cannon accelerator having features of the present invention.

FIG. 21 illustrates another embodiment of an interactive play element provided in the form of a pneumatic cannon accelerator 280. The cannon accelerator 280 basically comprises a barrel 283 mounted on a swivel base 284. The cannon barrel 283 is preferably formed of a suitable clear or translucent material such as acrylic or the like. One or more air bags or bladders 281 are disposed around the cannon accelerator 280, as shown, and are connected by flexible pneumatic hoses 282 to the barrel 283 of the cannon 280. Suitable check valves are provided for each hose 282 to prevent back-flow of air into the bags 281. In operation play media 104, in this case large foam balls are loaded into the open end of the barrel 283. A play participant then steps or jumps on one or more of the air bags 281 to inject air into the base of the barrel 283, thereby expelling the play media 104, as shown.

Figure 22:
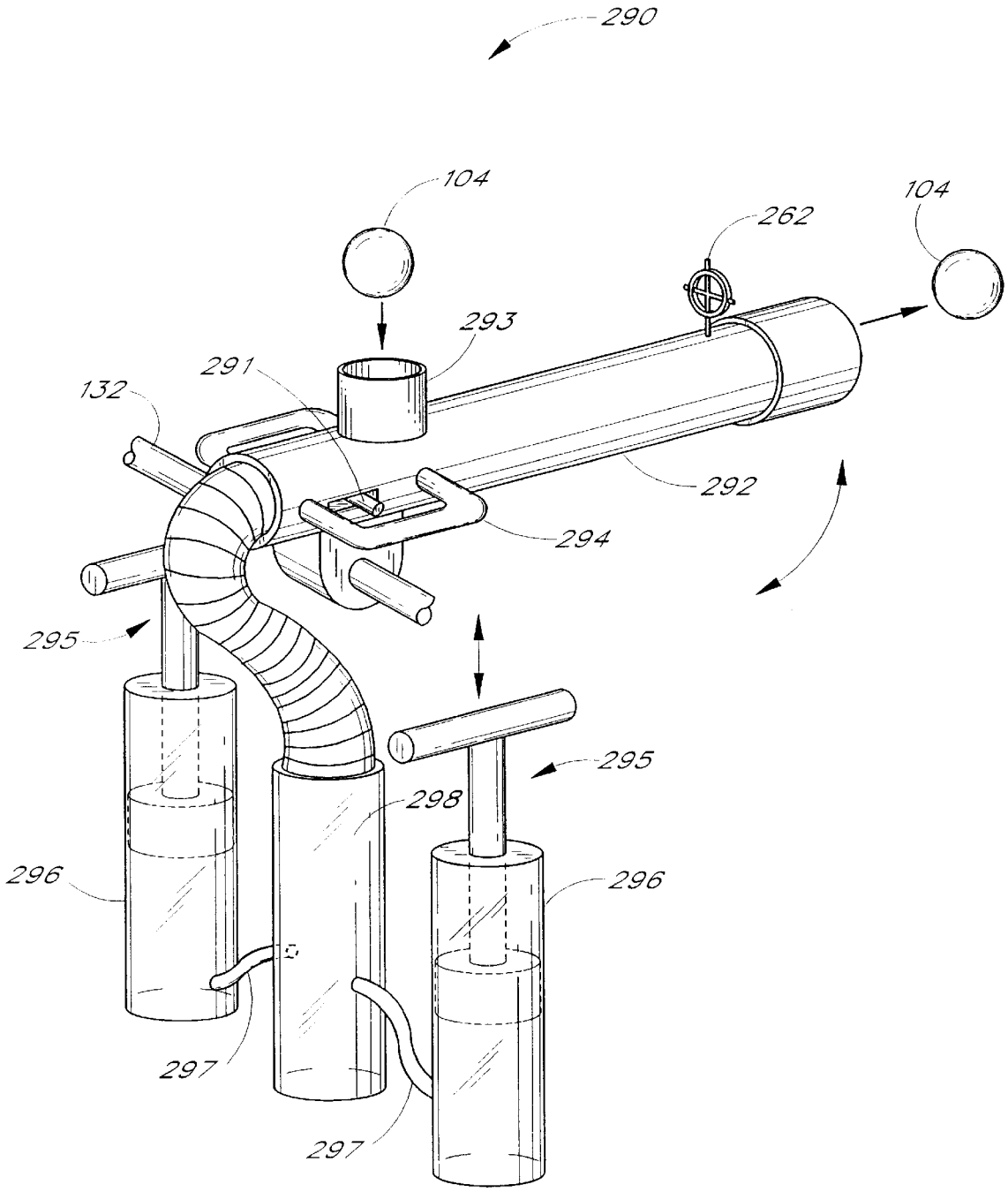
FIG. 22 is a perspective view of a pump-gun accelerator having features of the present invention.

Various types of pump-gun accelerators having features and advantages in accordance with the present invention are shown in FIGS. 22–26. FIG. 22 illustrates a dual-piston pump-gun accelerator 290 generally comprising a barrel 292, a charge reservoir 298, and a pair of air pumps comprising pump pistons 295 operable within corresponding cylinders 296. The pump-gun accelerator 290 may be swivel-mounted on a rail 132 of the play structure, or it may be mounted on a separate pedestal or the like, as desired. An optional gun sight 262 may be provided to assist in aiming the pump-gun accelerator 290 in a desired direction.

The pistons 295 are each adapted to be manually pumped by play participants, forcing air in the cylinders 296 into the charge reservoir 298 via flexible tubes 297. Suitable check valves (not shown) are provided in the charge reservoir 298 or in the corresponding tubes 297 to prevent backflow of air. Once the charge reservoir is charged to a desired pressure, a play participant depresses a trigger 291 adjacent the handle 294. This opens a valve and releases air under pressure into the gun barrel 292, thereby expelling the play media 104. The pressure of the air in the charge reservoir 298 as well as the relative diameters of the play media 104 and barrel 292 determine the exit speed of the projectile. Preferably, the barrel 292 is sized and shaped to have substantially the same diameter or slightly smaller diameter than the play media 104 in order to provide an adequate seal against the barrel 292 to prevent substantial air leakage around the play media 104 being propelled. Optionally, the maximum pressure in the charge reservoir 298 may be regulated by a relief valve or the like so as to maintain pressure at all times at safe levels.

Figure 23:
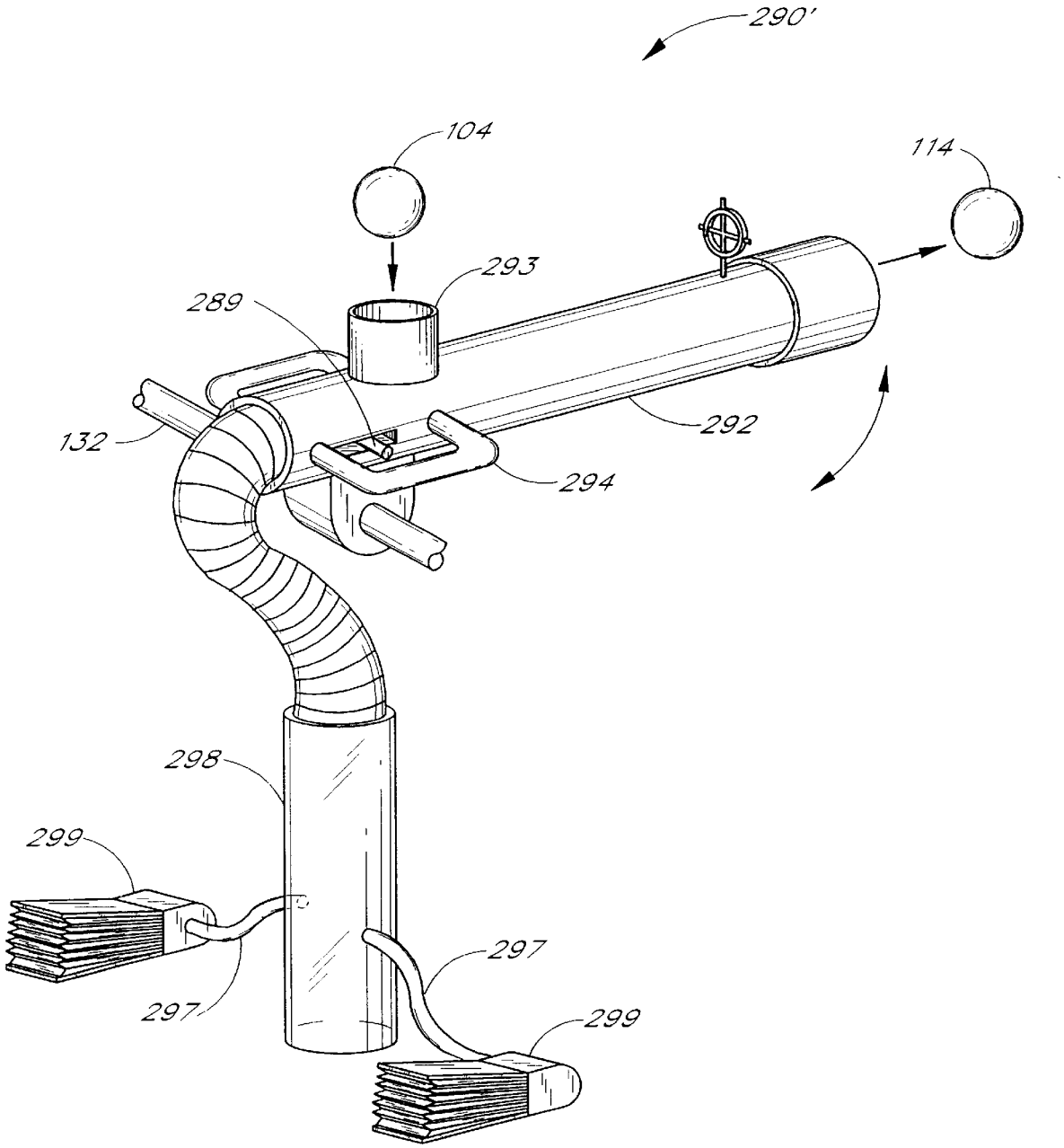
FIG. 23 is a perspective view of an alternative embodiment of a pump-gun accelerator having features of the present invention.

FIG. 23 illustrates a variation of the pump-gun accelerator of FIG. 22 in which foot pumps 299 are used to provide compressed air to the charge reservoir 298 of the pump-gun 290'. All other material respects of the pump-gun accelerator 290' are the same as that shown and described above in connection with FIG. 22, and, therefore, will not be repeated here.

Figure 24:
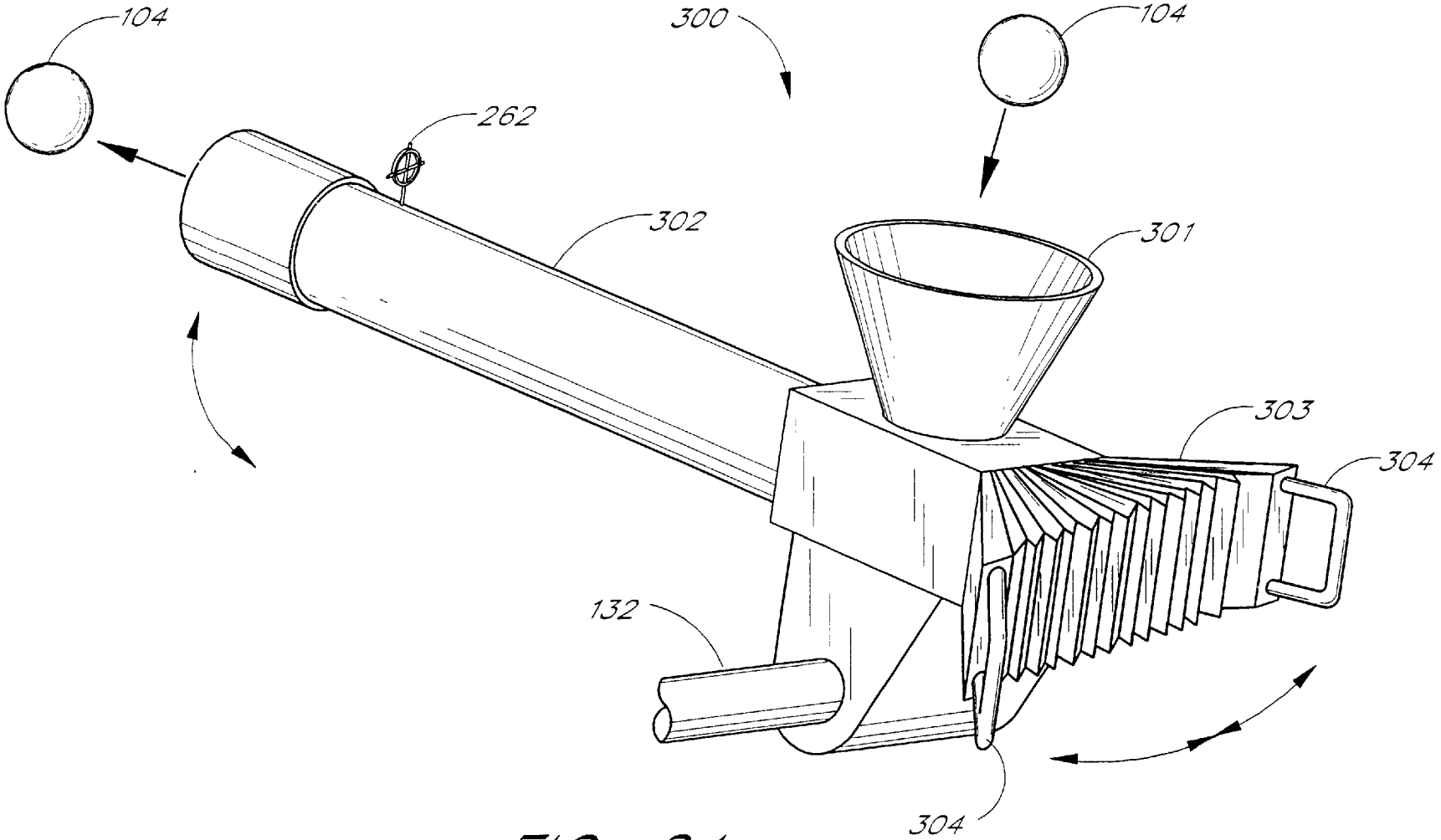
FIG. 24 is a perspective view of another alternative embodiment of a pump-gun accelerator having features of the present invention.

FIG. 24 shows another embodiment of a pump-gun accelerator 300 having features and advantages in accordance with the present invention. In this case, the pump-gun accelerator 300 is provided in the form of a "bellows gun" in which bellows 303 are compressed by a play participant to inject air into the barrel 302 to propel play media 104. Again, the bellows gun accelerator 300 may be swivel-mounted to a rail 132 of the play structure or to a separate pedestal or base, as desired. In operation, play media 104 is loaded into a loading funnel 301 which guides the play media 104 into the entrance of the barrel 302. A play participant then compresses the bellows 303 using handles 304 to force compressed air into the barrel 302, thereby expelling the play media 104 from the barrel 302 of the pump-gun accelerator 300, as shown.

Figure 26:
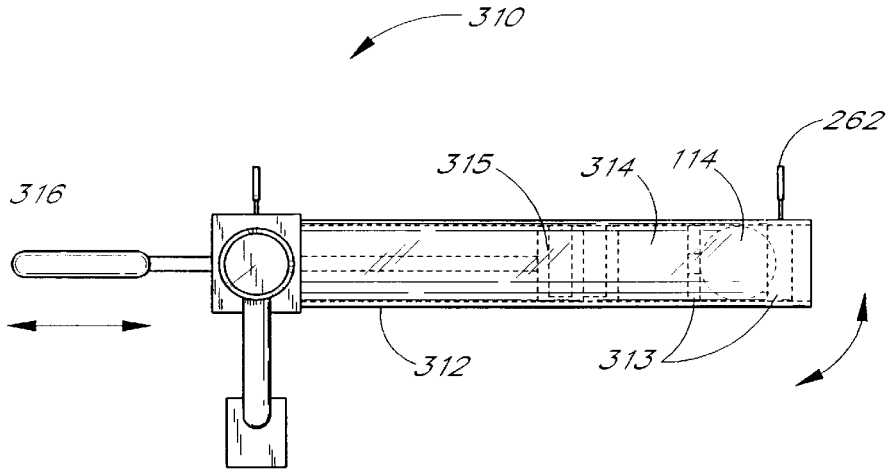
FIGS. 25 and 26 are top plan and side elevational views, respectively, of a dual-cylinder pump-gun accelerator having features of the present invention.
Figure 25:
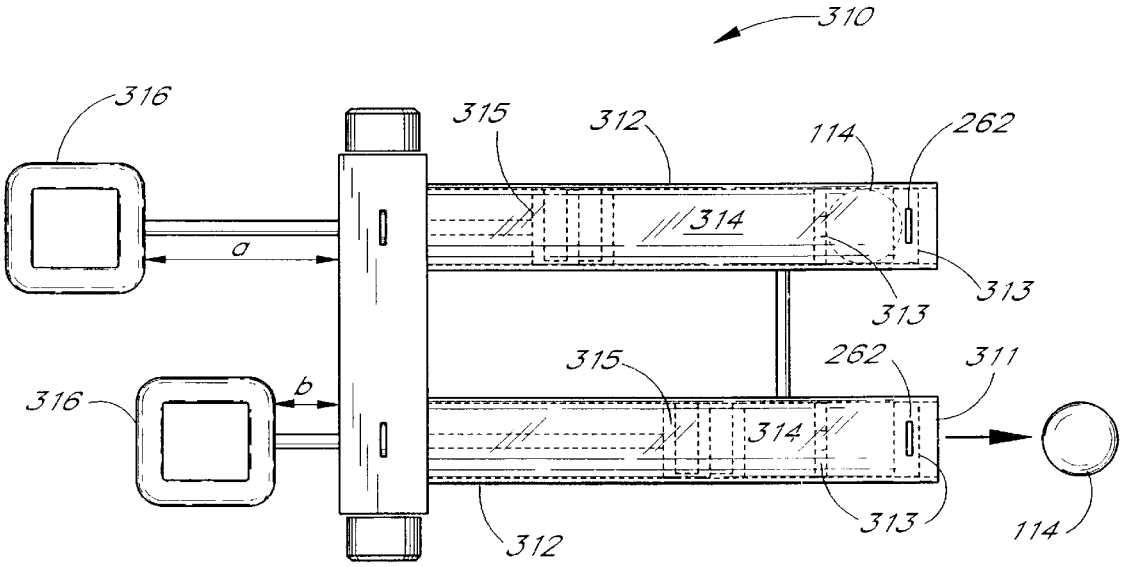

FIGS. 25 and 26 illustrate another possible embodiment of an interactive play element provided in the form of a dual-chamber pump-gun accelerator 310. The pump-gun accelerator 310 basically comprises a pair of tubular barrels 312 in which are disposed corresponding pump pistons 315. In operation, play media 104 is loaded into a distal end of one or both barrels 312. The play media 104 is held in place by one or more O-rings 313 or the like, as shown. For example, O-rings 313 may be positioned at the distal ends 311 of the barrels 312 and may have an inner diameter slightly less than the diameter of the play media 104, so that a seal forms between the O-ring 313 and the play media 104 substantially impeding the escape of air from each barrel 312. A proximal portion of each barrel 312 forms a compression chamber 314 between each piston 315 and the play media 104. The pistons 315 are each operated via a corresponding handle 316 located outside the barrel 312.

When play media 104 is inserted into the end of each barrel 312, the barrel 312 is effectively plugged. That is, the size of play media 104 and the inner diameter of the barrel 312 are substantially equal or in slight interference. Optional rings 313 keep the play media 104 from being sucked into the barrel 312 when the piston handle 316 is withdrawn to position "a", as shown. When the handle 316 is pushed into position "b," the piston 315 compresses the air between the piston 315 and the play media 104, ultimately expelling the play media 104 out the end of the barrel 312 much in the same way as a cork gun expels a cork.

FIGS. 27A and 27B illustrate another possible embodiment of an interactive play element in the form of a solenoid-activated pneumatic accelerator 320, 320'. Again, these accelerator devices 320, 320' may be swivel-mounted to a rail of the play structure or to a separate pedestal or base, as desired. Each of the accelerators 320, 320' utilizes a remote source of compressed air which is controlled by a switch-activated solenoid valve 321 or other suitable means which can be selectively activated by play participants to charge the barrel 322 with compressed air, thereby propelling play media 104. A first pneumatic line 325 provides compressed air from a source (not shown). A second pneumatic line 326 from the solenoid valve 321 relays compressed air to the barrel 322 of the accelerator.

The accelerator 320 shown in FIG. 27A is essentially a one-shot device in which play media 104 must be loaded one article at a time and then fired. The accelerator 320' shown in FIG. 27B is a variation of that shown in FIG. 27A in which an automatic or repeating operation is achieved. In this embodiment, play media 104 may be automatically fed by a supply basket 323 which, in turn, is fed by a conduit 324 or by other play participants. The solenoid valve 321 may be foot-operated or finger-operated, as desired, depending upon where the switch 327 is placed.

Optionally activation of the solenoid valve 321 may rely, in part, on a programmable logic controller (PLC) 328 for providing automated, semi-automated, or sequenced firing of the accelerator 320', as desired, to simulate a machine gun or other desired effect. PLC 328 may comprise any one of a number of microchip devices well known in the art which are capable of being programmed to provide desired control of an associated device.

Although not shown in the drawings, any of the above-described accelerators may be decorated or "themed" to convey a particular desired play theme or idea. For example, accelerators may be configured to simulate cannons, laser guns, machine guns or the like. Accelerators may be mounted within a plexiglass hemisphere mounted under a floor of an upper level of the play structure so as to simulate a gunner's turret of a World War II bomber. Yet other accelerators may be mounted on a moving vehicle, such as a train or steerable vehicle, capable of transporting one or more play participants. Roving vehicles such as an automobiles, buses tanks or space ships may also provide an exciting complement to a particular desired theme.

Of course those skilled in the art will readily appreciate that a wide variety of other projectile accelerators and the like may be, and desirably are, provided throughout the various levels of the play structure in order to allow play participants to interact with one another using the various play media and interactive play elements.

Interactive Targets

The following table is provided for convenience in identifying the various elements of the invention as shown and described in connection with FIG. 28:

TABLE 3

| Ref. | Description |
|---|---|
| 500 | Interactive Target |
| 503 | Upper Target |
| 505 | Middle Target |
| 507 | Lower Target |
| 509 | Upper Support |
| 511 | Funnel Target |
| 513 | Aperture Target |
| 515 | Spinner Target |
| 516, 518 | Drop Targets |
| 519 | Conduit |
| 521–525 | Valves |
| 527 | Ball Drop |
| 533 | Exit Nozzle |
| 529 | Impact Surface |
| 551 | Support Wires |
| 553 | Pneumatic Accelerators |
| 555 | Hanging Target |
| 557 | Middle Spinner |
| 559 | Upright Target |
| 561 | Large Funnel Target |
| 562 | Feed Tubes |
| 563 | Small Funnel Target |
| 565 | Truss Support |
| 567 | Upper Funnel |
| 569 | Exit Nozzle |
| 591 | Truss Support |
| 593 | Fan |
| 595 | Fan Shroud |

Figure 28:
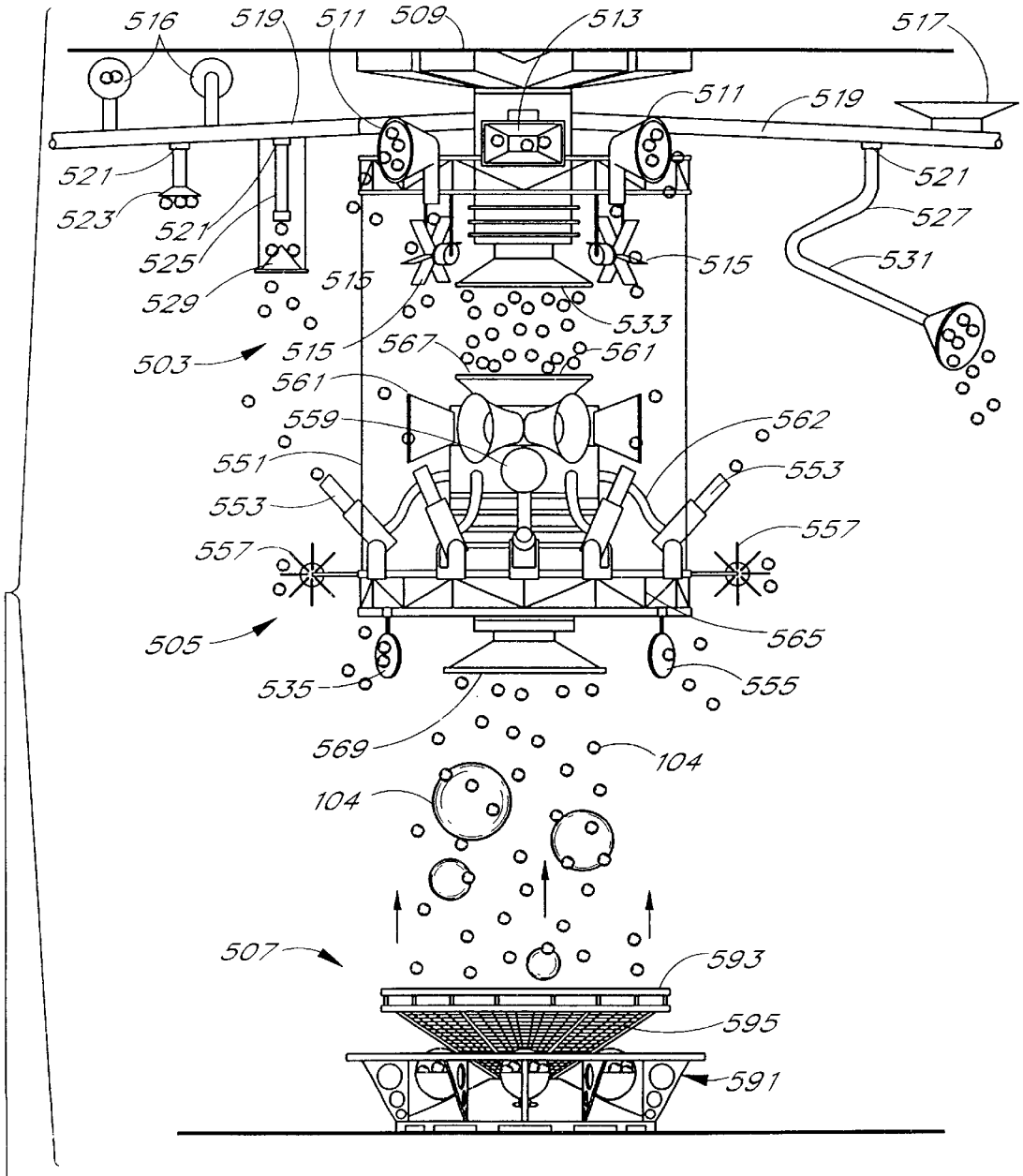
FIG. 28 is a perspective view of an interactive target having features of the present invention.

FIG. 28 shows one preferred embodiment of an interactive target 500 having features and advantages of the present invention. The target 500 basically comprises three target components: an upper target portion 503, a middle target portion ("mega target") 505, and a lower target portion ("mega blower") 507, as shown. Beginning with the upper target portion 503, this target generally comprises a target or support structure 509 disposed in, on or around the play structure 100. A variety of funnel targets 511, aperture targets 513, spinners 515, and the like are mounted on the support structure 509, as shown. Play participants activate the targets by causing a projectile to enter the open areas of the funnel or aperture targets 511, 513 or to impinge upon the paddle surfaces of the spinner targets 515. In the particular embodiment shown, the funnel targets 511 are arranged so that play media 104 entering the funnels 511 exits downwardly onto the spinners 515. Thus, if a play participant manages to get play media 104 into the funnel target 511 it drains downward onto the spinning target 515 causing it to spin as the play media 104 impinges upon one or more paddles of the spinner 515. Other targets 516 and 517 are arranged along a conduit 519, as shown, and operate to open or close valves 521 or other devices which release play media 104 from the conduit 519 into various ball drops 523, 525, 527. Ball drop 523 releases play media 104 substantially straight downward as shown. Ball drop 525 releases play media 104 down a barrel impinging a suspended conical impacting surface 529 which scatters play media within a 360° radius from the ball drop 525. Ball drop 527 allows play media 104 to flow into a flexible conduit 531 which may be controlled remotely such as by electromechanical actuators. Target 517 is actuated if play media is caused to land on top of the funnel-shaped entrance and drains down into the conduit 519. A sensor or other mechanism may sense the entry of play media 104 and trigger one or more other effects as desired.

The nature of the effects, duration and number of elements involved may vary depending upon the difficulty of actuating the various associated targets. For example, targets that are very difficult to hit may produce more dramatic effects so as to encourage play participants to actuate those effects by hitting the appropriate targets in the appropriate order. Various sound effects, flashing lights and other related effects may add to the excitement or assist play participants by informing them which targets need to be hit in which order to produce the desired effects. In this manner, play participants cooperate to activate the targets in the desired order to create the desired play effect. As a reward for activating a major play effect, play media may be released from a central chamber to yet other play devices to increase the level of excitement in the play structure. Alternatively, interactive play elements may change from manual loading to automatic or semi-automatic operation as a reward for actuating certain targets. This, in turn, may assist play participants to activate even further targets to achieve the next level of reward.

The intermediate target portion 505 or "mega target" is provided roughly intermediate the upper target 503 and the lower target 507. Preferably, the intermediate target 505 is suspended by wires 551 hanging from the upper target or other support structure as needed. Alternatively, the target structure 503 may be cantilever-mounted or supported in any one of a number of other ways well known to those of skill in the art. The mega target 505 includes a plurality of pneumatically actuated accelerators 553 which are adapted to propel play media 104 into the air or back at play participants in response to one or more of the targets 555, 557, 559, 561, or 563 being actuated. The targets 555 may be of a type that are switch or sensor activated such that when a projectile contacts the target surface, a switch is closed or opened to actuate an adjacent play effect such as one of the pneumatic accelerators 553. Alternatively, the targets 561 may be provided in the form of feed cones such that when play media enters the target 561 it flows down through a line 562 and is automatically shot out of one of the corresponding accelerators 553. Spinner targets 557 may be activated by causing a projectile to contact a paddle surface of the spinner target 557. This in turn, may activate any one of a number of other effects on the interactive mega target 500 or any of a variety of other interactive play elements or play effects disposed throughout the play structure. Preferably, the accelerators 553 are mounted such that they randomly swivel up and down and/or side to side so that the projectile path of play media 104 exiting each accelerator 553 is unpredictable. This adds to the level of excitement in and around the interactive target 500. A cylindrical or donut-shaped truss 565 provides a secure platform for mounting the various targets and accelerators.

In accordance with one particularly preferred embodiment of the present invention, a major interactive target effect is actuated, for example, when play media enters the target 513 and flows downward through the center body of the upper target exiting the nozzle 533 into the cone-shaped funnel 567 of the mega target and down through the exit nozzle 569. This may trigger a wide variety of different effects including interactive effects, bells, sounds, lights, whistles, and the like similar to a jackpot on a slot machine or pinball machine. The target 513 is preferably adjusted or selected so as to provide a certain degree of difficulty in actuating the target so that the target effects will be fairly uncommon and, therefore, desirable.

The lower target 507 is in the form of a "mega blower" comprising a disk-shaped or donut-shaped truss assembly 591 supporting a fan 593. The fan has one or more rotating fan blades (not shown) enveloped in a cone-shaped protective shroud 595. The fan may be powered by play participants or an external energy source, as desired. The shroud 595 may be in the form of a wire mesh or similar material that admits air but prevents fingers and arms from entering the fan area. The mega blower 507 blows a jet of air upward so as to entrap or entrain various lightweight play media 104 as shown. These may include small foam balls or larger size foam balls, balloon balls, or beach balls, as desired.

The above interactive target has been described and shown for illustrative purposes only. Those skilled in the art will readily appreciate that a wide variety of different types, sizes, and shapes of interactive targets having features and advantages in accordance with the present invention may be provided.

Interactive Conveyors

To supply the various interactive play elements and other effects with a play media 104, various devices are preferably provided to collect and transport play media in and around the play structure. These may include, for example, passive collection and/or transportation devices, such as collection basins, channels and/or troughs, or they may include active or interactive collection and transportation devices. Various conveyor systems are disclosed and described herein by way of illustration only. Those skilled in the art will readily appreciate that a wide variety of other collection and/or transportation devices may be used while still enjoying the advantages and benefits of the present invention as taught herein.

The following table is provided for convenience in identifying the various elements of the invention as shown as described in connection with FIGS. 29–40:

TABLE 4

| Ref. | Description |
|---|---|
| 330 | Horiz. Conveyor |
| 331 | Rotatable Tube |
| 333, 355 | Base |
| 336 | Crank Handle |
| 337 | Drive Gear |
| 338 | Tube Drive Portion |
| 339 | Exercycle |
| 341 | Shaft |
| 342 | First Belt Wheel |
| 343 | Belt |
| 344 | Second Belt Wheel |
| 345 | Spiral Ridges |
| 350 | Paddle Wheel Conveyor |
| 351 | Inlet Tube |
| 353 | Housing |
| 354 | Rotating Paddles |
| 355 | Hand Crank |
| 357 | Exit Tube |
| 358 | Exit Point |
| 360 | Plunger Conveyor |
| 361 | Collection Basket |
| 362 | Floor Stand |
| 363 | Feed Basket |
| 364 | Housing |
| 365 | Handle |
| 366 | Plunger Shaft |
| 367 | Plunger |
| 368 | Exit Tube |
| 370 | Vertical Tube Conveyor |
| 371 | Rope |
| 372 | Upper Pulley |
| 373 | Lower Pulley |
| 376 | Supply Hopper |
| 377 | Collection Basket |
| 378 | Vertical Tube |
| 380 | Belt Conveyor |
| 381 | Collection Basket |
| 382 | Inlet Opening |
| 383 | Slanted Floor |
| 384 | Housing |
| 386 | Crank Handle |
| 387 | Drums |
| 388 | Belt |
| 390 | Outlet Opening |
| 400 | Flywheel Conveyor |
| 401 | Exercycle |
| 402 | Flywheel |
| 403 | Collection Basket |
| 405 | Drive Chain |
| 406 | Drive Gear |
| 407 | Pedals |
| 408 | Supply Hopper |
| 409 | Housing |
| 420 | Archimedes Conveyor |
| 421 | Outer Tube |
| 422 | Grooved Inner Surface |
| 423 | Supply Hopper |
| 424 | Supply Base |
| 425 | Collection Basket |
| 426 | Roller Bearings |
| 427 | Supports |
| 428 | Belt Drive |
| 429 | Hand Crank |

Figure 29:
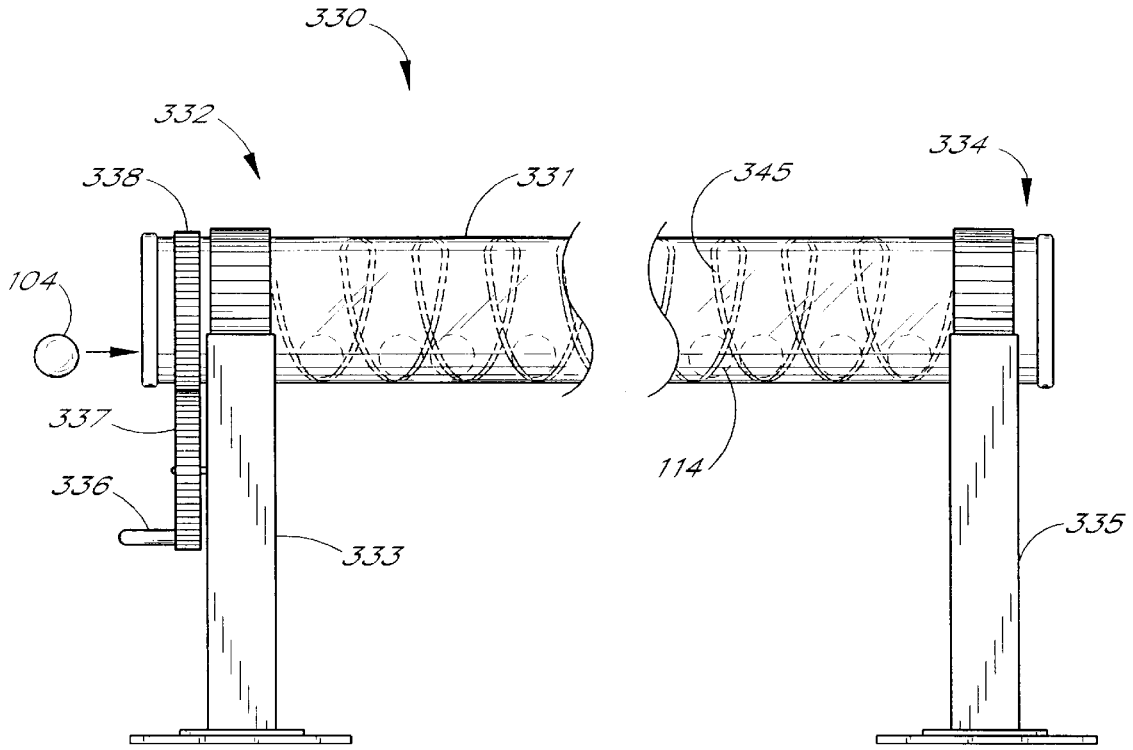
FIGS. 29 and 30 are front and right side elevational views, respectively, of a horizontal tube conveyor having features of the present invention.
Figure 30:
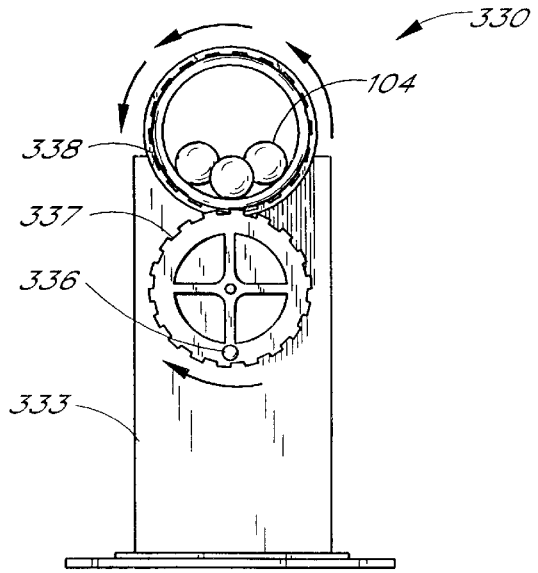
Figure 31A:
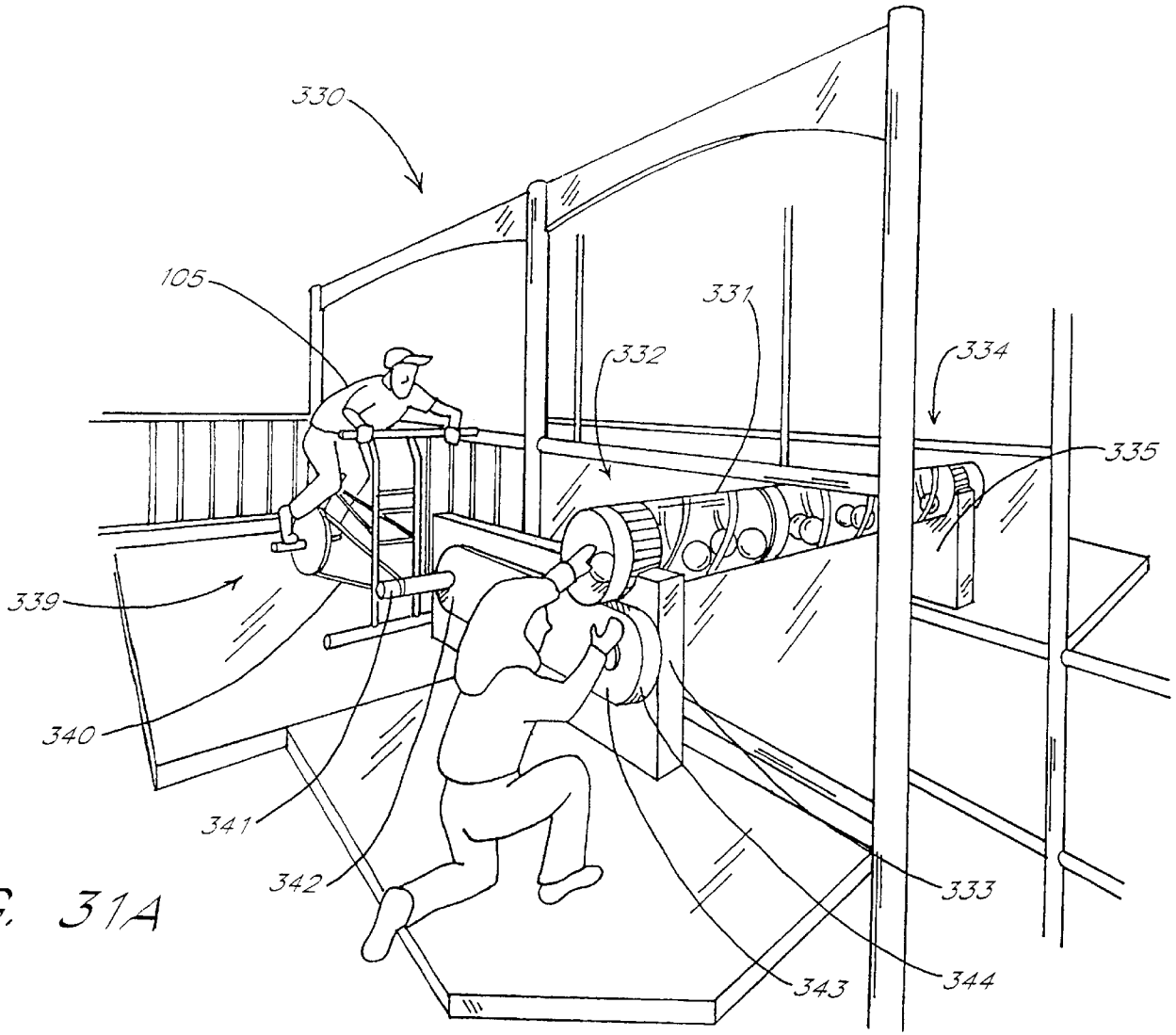
FIG. 31 is a perspective view of the tube conveyor of FIGS. 29 and 30 showing one possible mode of operation by multiple play participants.
Figure 31B:
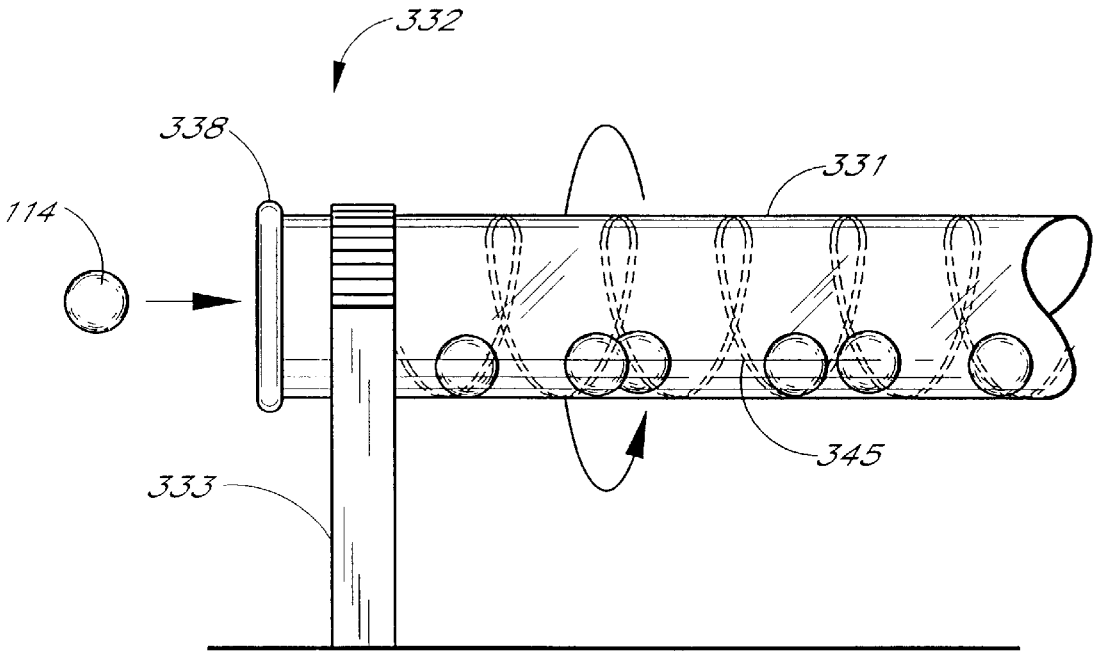

FIGS. 29–31 illustrate one possible embodiment of an interactive conveyor device provided in the form of a horizontal tube conveyor 330. The tube conveyor 330 basically comprises a hollow tube 331, preferably formed of a suitable clear or translucent material such as acrylic. A hand crank 336 and gears 337, 338 are provided for rotating the tube 331. The tube 331 preferably has spiral ridges 345 or the like formed on the inner surface thereof for moving play media 104 axially along the tube 331. Play media is transported across a predetermined horizontal distance as the tube is rotated in a desired direction.

The tube 331 is rotatably supported at either end by a pair of base members 333, 335. Play media 104 may be fed into either end of the tube and the tube may be rotated by play participants to transport play media in a desired direction. In the particular preferred embodiment shown, a crank 336 is provided at one end 332 of the tube conveyor 330 for driving a gear 337 which mates with a toothed portion 338 of the tube 331. A play participant cranks the handle 336, thereby causing the tube 331 to rotate such that play media 104 in the tube travels horizontally across the tube 331 in a desired direction.

Optionally, a tube conveyor 330' (FIG. 31) may be rotated by a belt which is driven by a remotely located stationary bicycle 339 which may be on the same or a different level. A shaft 341 is driven by a wheel of the stationary bicycle 339, as shown. The shaft, in turn, drives a first belt-wheel 342 which drives second belt-wheel 344, which turns the tube 331. Thus, a play participant 105 on the bicycle 339 causes the tube 331 to rotate. The bicycle 339 may be positioned as near or as far from the tube conveyor 330' as desired. Alternatively, a treadmill (not shown) or any other type of device for producing energy from human effort may be substituted for the bicycle 339 or hand crank 336, as desired.

Figure 33:
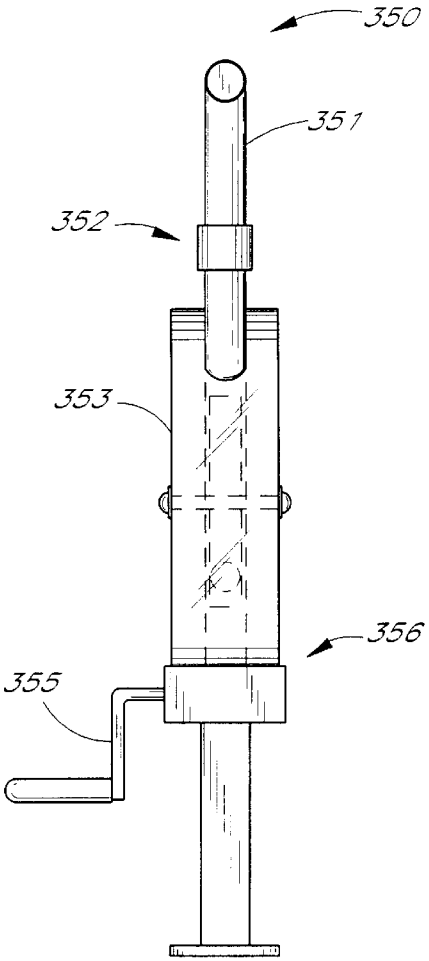
FIGS. 32 and 33 are front and right side elevational views, respectively, of a paddle wheel conveyor having features of the present invention.
Figure 32:
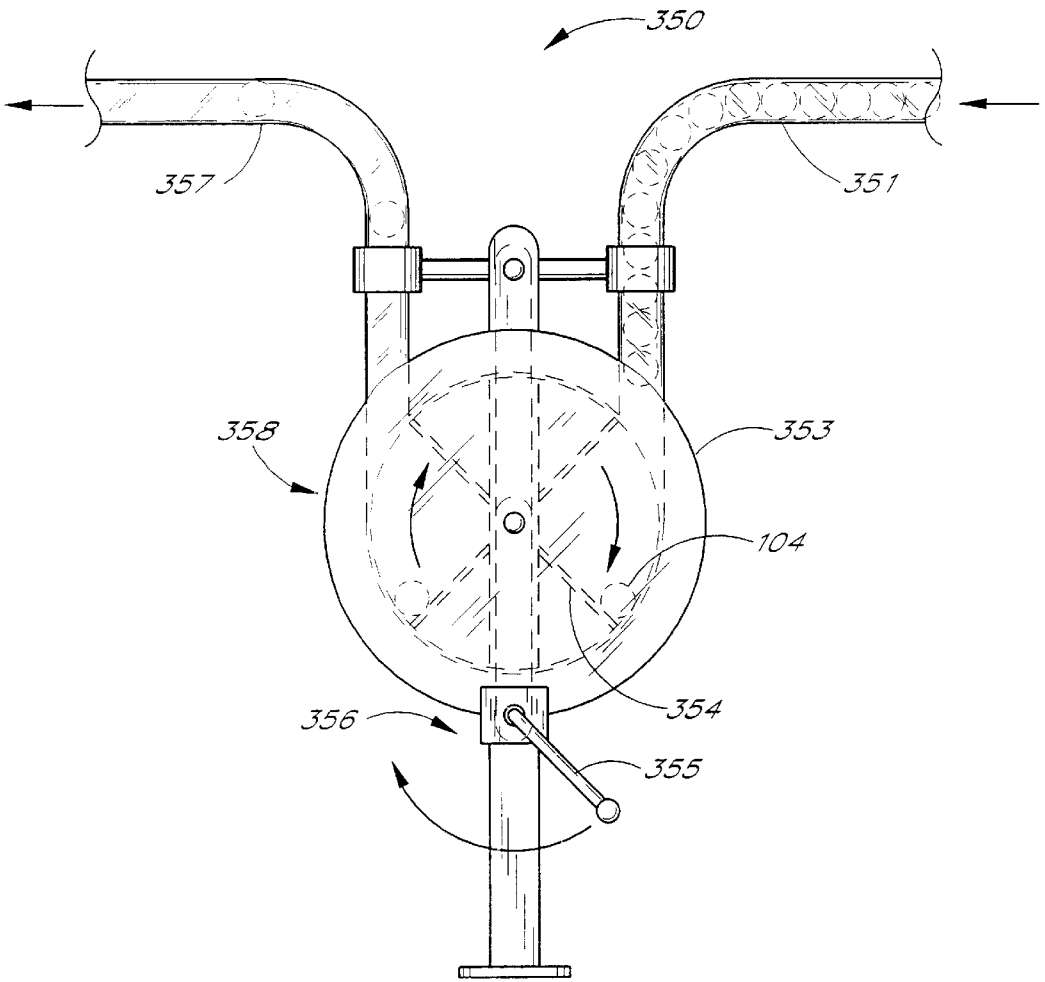

FIGS. 32 and 33 show another type of interactive conveyor device in the form of a paddle wheel conveyor 350. The paddle wheel conveyor basically comprises a housing 353 within which is disposed a rotatable paddle wheel 354. A crank 355 is adapted to allow play participants to impart a desired amount of rotational speed to the paddle wheel 354. Preferably, a step-up gear ratio is provided such that a relatively slow rotational speed of the crank 355 causes relatively fast rotational speed of the paddle wheel 354 such that the paddle wheel 354 rotates fast enough to impart sufficient energy to the play media 104 to propel it up into the exit tube 357. The paddle wheel 354 accelerates the play media 104 such that the centrifugal force exerted by the play media 104 when it reaches a point 358 between the paddle wheel 354 and the exit tube 357, is adequate to lift the play media 104 up into the exit tube 357. The exit tube 357 may be negatively pressurized relative to the inlet tube 351, as desired, to prevent play media 104 from falling back into the housing 353. Optionally, two or more centrifugal conveyors 350 may be connected together, driven by the same crank(s), in order to provide parallel propulsion of play media 104 between various portions of the play structure.

Figure 34:
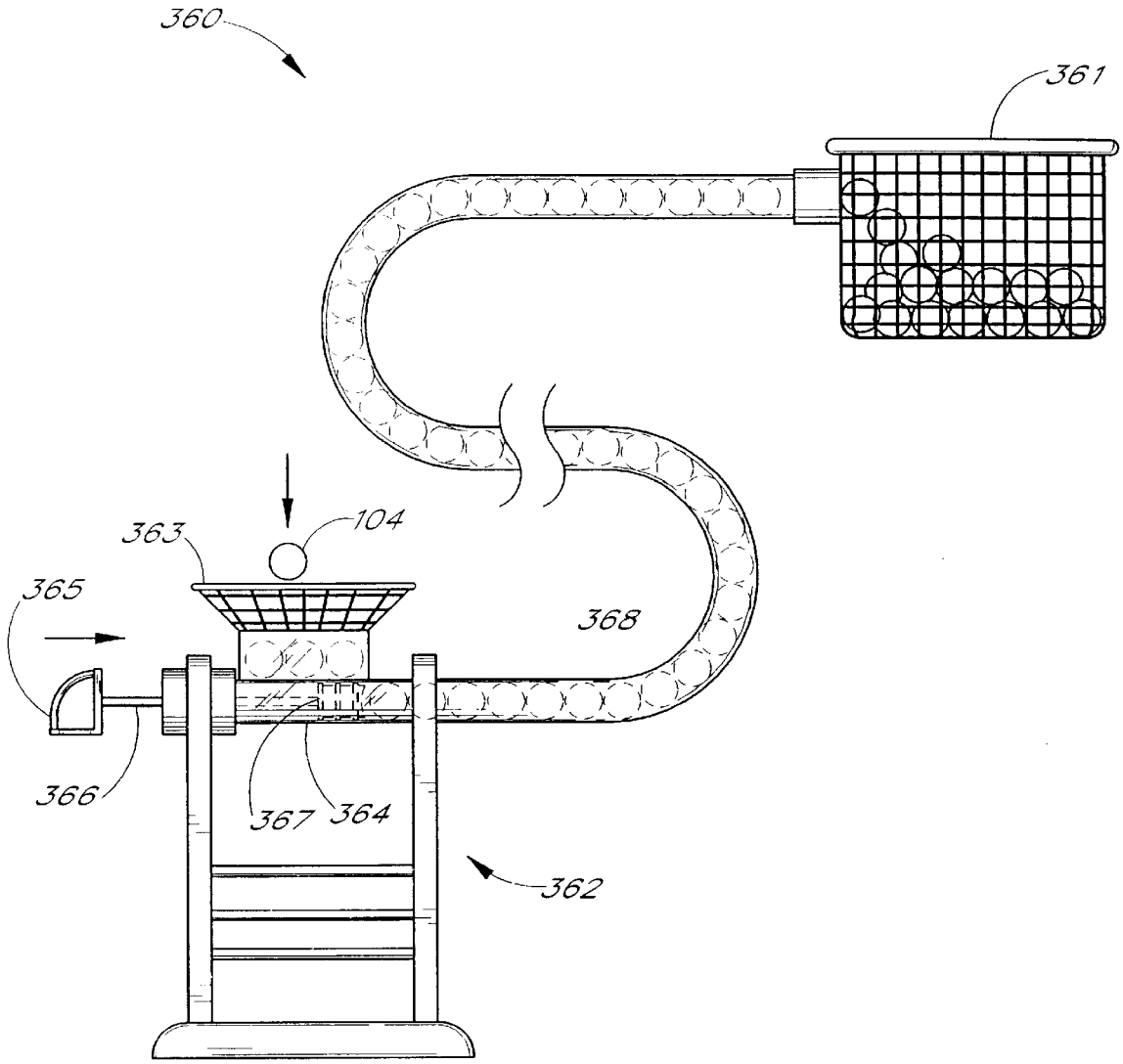
FIG. 34 is a side elevational view of a plunger conveyor having features of the present invention.

FIG. 34 illustrates another possible interactive conveyor device provided in the form of a plunger conveyor 360. In this device a tube housing 364 is provided having an opening at the top for admitting play media 104, and a plunger 367 for compacting the play media into a conveyor tube 368, as shown. Play media 104 exits the conveyor tube 368 into a collection basket 361 or other receptacle as desired. This may be on the same or a different level of the play structure, as desired. The plunger conveyor 360 may be rail mounted or it may be mounted to a floor stand 362, as shown.

In operation, play participants fill a feed basket 363 on top of a housing 364 with play media 104. A play participant then pulls out the handle 365 which is connected to a shaft 366 which operates the plunger 367. With the plunger 367 retracted, play media drops into the housing 364. When the play participant pushes on the handle 365, the plunger 367 forces the play media 104 into the tube 368. This may be either a fixed or flexible tube, as desired. In order to prevent play media from rolling backwards from the tube 368 back into the housing 364 an optional clip or ring may be mounted on the inner diameter of the tube 368 adjacent the housing 364 to prevent backflow of play media 104 into the housing 364.

Figure 35:
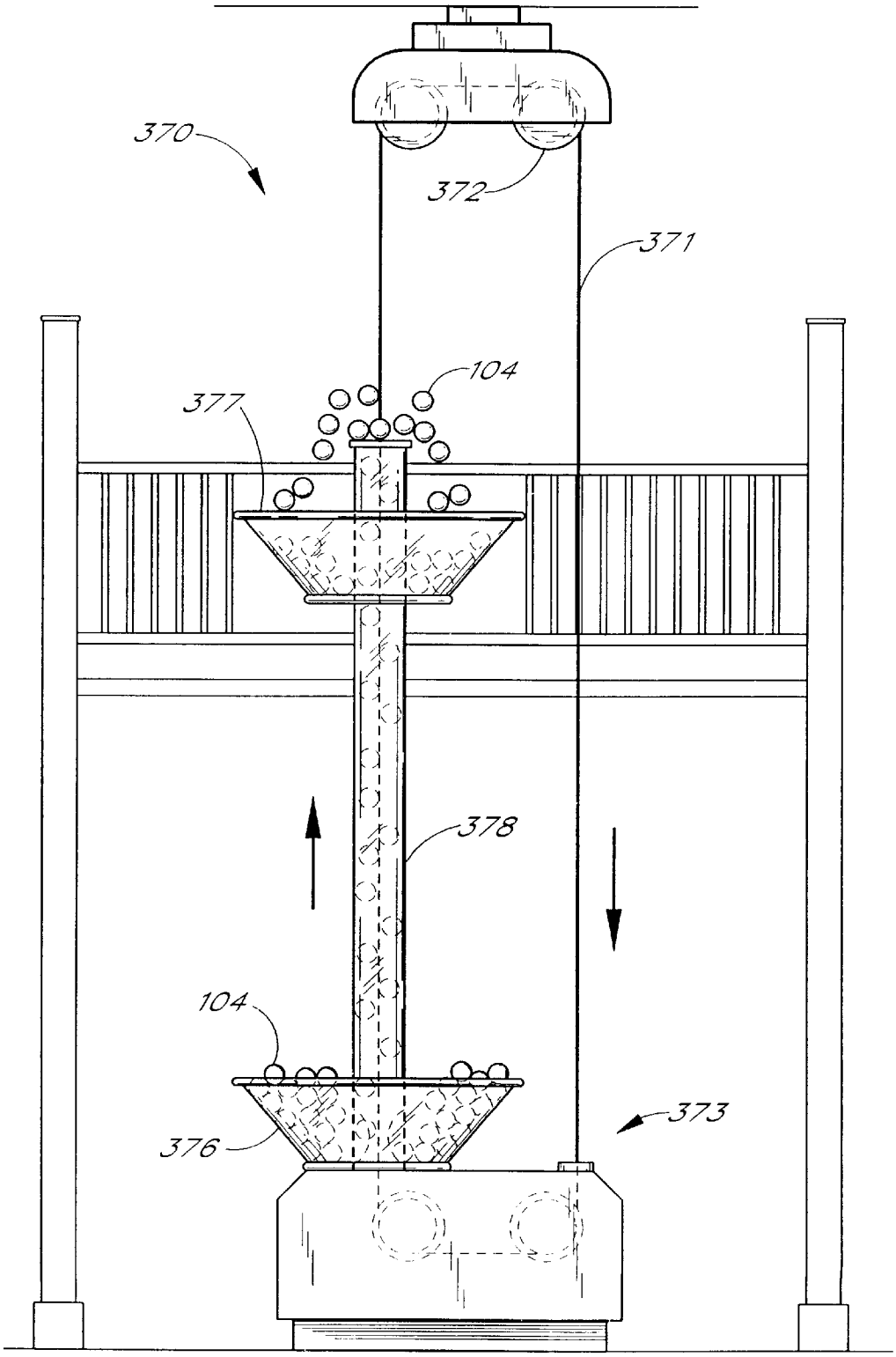
FIG. 35 is a front elevational view of a vertical tube conveyor having features of the present invention.

FIG. 35 illustrates another possible embodiment of an interactive conveyor device provided in the form of a vertical tube conveyor 370. The vertical tube conveyor 370 basically comprises a hollow vertical tube 378, preferably formed of a suitable clear or translucent material, having a rope or cable 371 passing axially therethrough. The rope 371 extends vertically upward through the tube 378 and around upper and lower pulleys 372, 373 to form a closed loop. The rope 371 may be pulled downward by one or more play participants to cause the rope 371 to move upward through the tube 378. As the rope 371 moves upward within the tube 378 play media 104 in the supply basket or hopper 376 is fictionally engaged between the rope 371 and the inner wall of the tube 378 such that the play media rolls up upward through the tube 378, as shown. At the top of the tube 378, play media 104 flows out into the collection basket 377. Play participants can watch as play media is carried up the tube 378.

Figure 36:
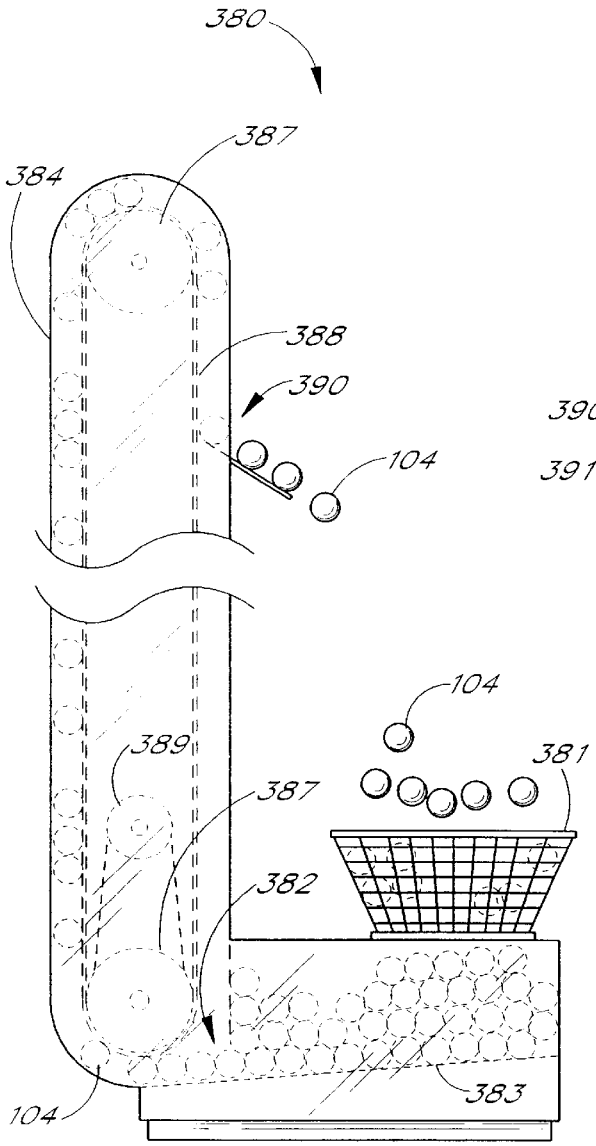
FIGS. 36 and 37 are front and left side elevational views, respectively, of a vertical belt conveyor having features of the present invention.
Figure 37:
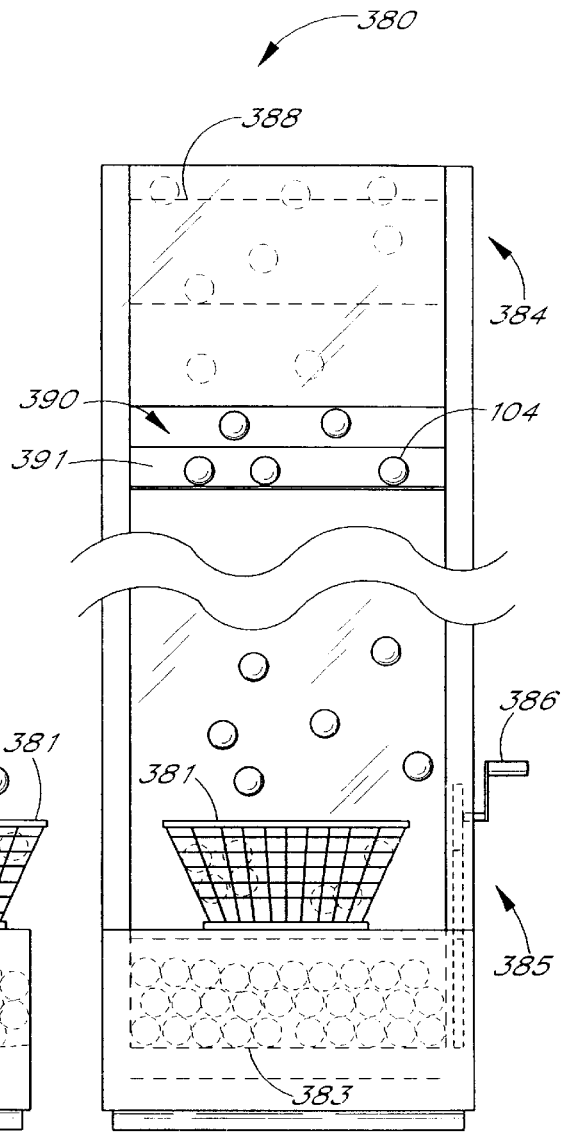

FIGS. 36 and 37 illustrate one possible variation of the vertical tube conveyor 370 shown in FIG. 35. In this embodiment, a conveyor device is provided in the form of a vertical belt conveyor 380. The vertical belt conveyor 380 generally comprises a housing 384 within which is disposed a vertical conveyor belt system extending between a pair of belt-wheels 387. A crank handle 386 is adapted to be turned by a play participant to cause the belt 388 to move in a desired direction. The belt 388 and housing 384 are separated by a distance at least slightly smaller than the diameter of the play media 104 (in this case preferably foam or rubber balls). As a play participant turns the crank 386, play media flows down a slanted floor 383 into an opening 382 provided in the housing 384. The belt 388 moves relative to the inner wall of the housing 384 trapping play media 104 between the belt 388 and the inner surface of the housing. This causes the play media 104 to roll upward through the housing against the moving belt 388. Near the top of the housing 384, an outlet opening 390 is provided allowing play media to exit the housing 384 into an adjacent conduit, onto other play participants or back into the collection basket 381 which supplies the vertical belt conveyor 380, as desired.

Figure 39:
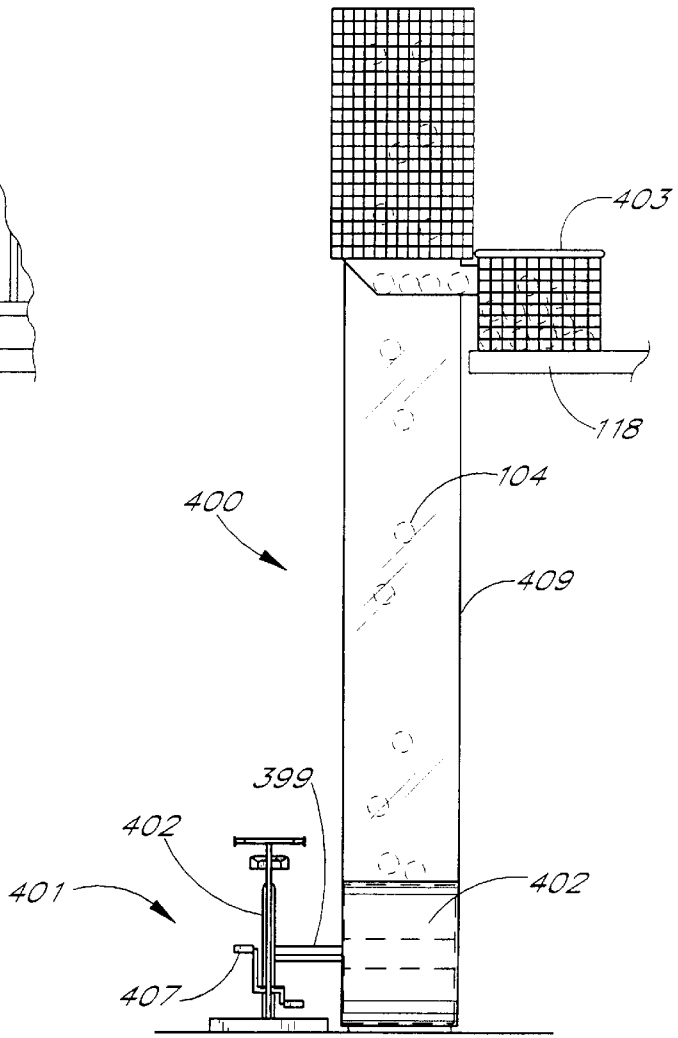
FIGS. 38 and 39 are front and right side elevational views, respectively, of a flywheel conveyor having features of the present invention.
Figure 38:
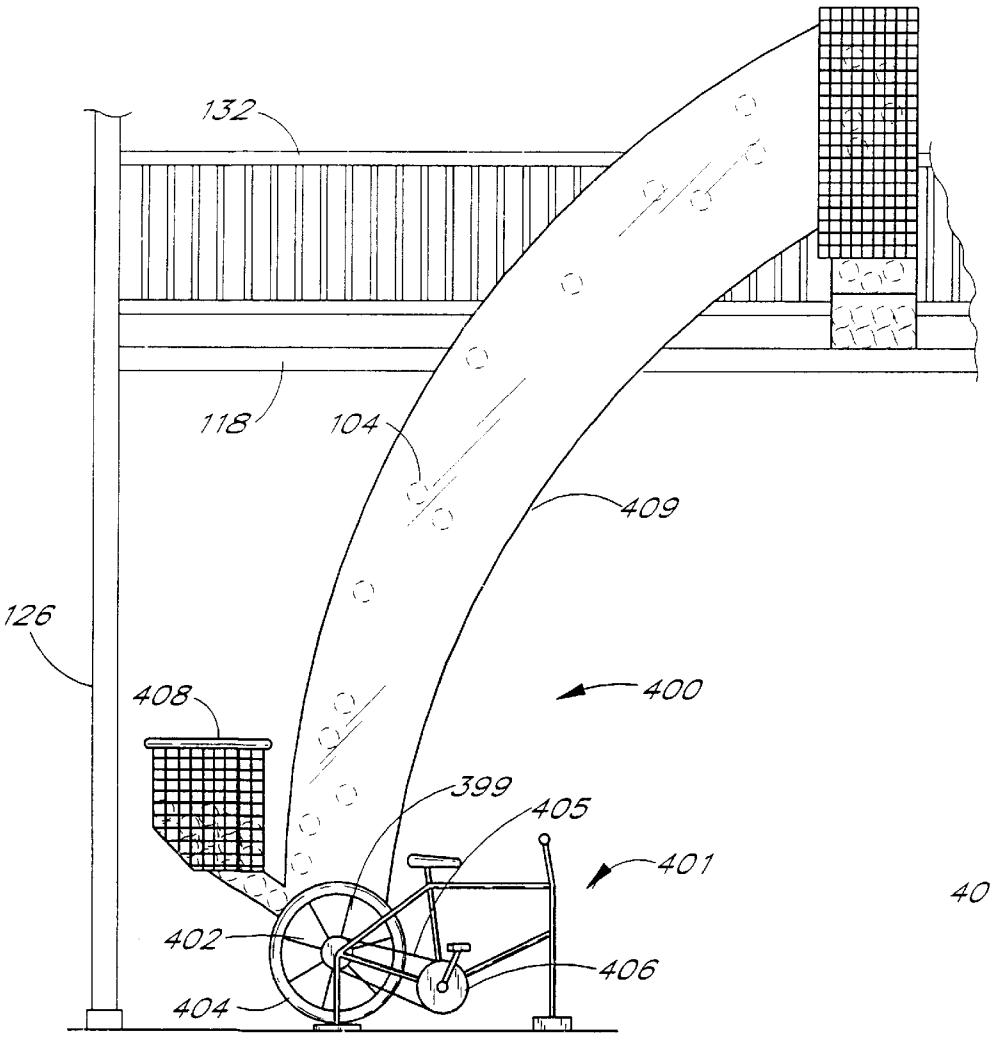

FIGS. 38 and 39 illustrate another possible interactive conveyor device provided in the form of a flywheel conveyor 400. This conveyor utilizes a stationary bicycle 401 to rotate a flywheel 402 to a relatively high velocity such that it flips or flings play media 104 from a lower collection basket 408 into an elevated collection basket 403. The flywheel 402 is mounted on a common shaft 399 with the drive wheel of the stationary bicycle 401. The shaft 399 is driven by a chain drive system which includes a crank gear 406, pedals 407 and a chain 405. The flywheel 402 is disposed within an elongated arcuate housing 409, which provides a deflection path for play media flung from the flywheel 402. Preferably the housing is formed at least partially of a clear or translucent plastic material so that play participants can observe the inner workings of the conveyor and play media 104 impacting and being flung from the flywheel 402. If desired, the stationary bicycle 401 may be provided with a variable gear system in order to allow play participants to attain various desired rotational speeds of the flywheel 402 and, therefore, rate of conveyor operation.

Figure 40:
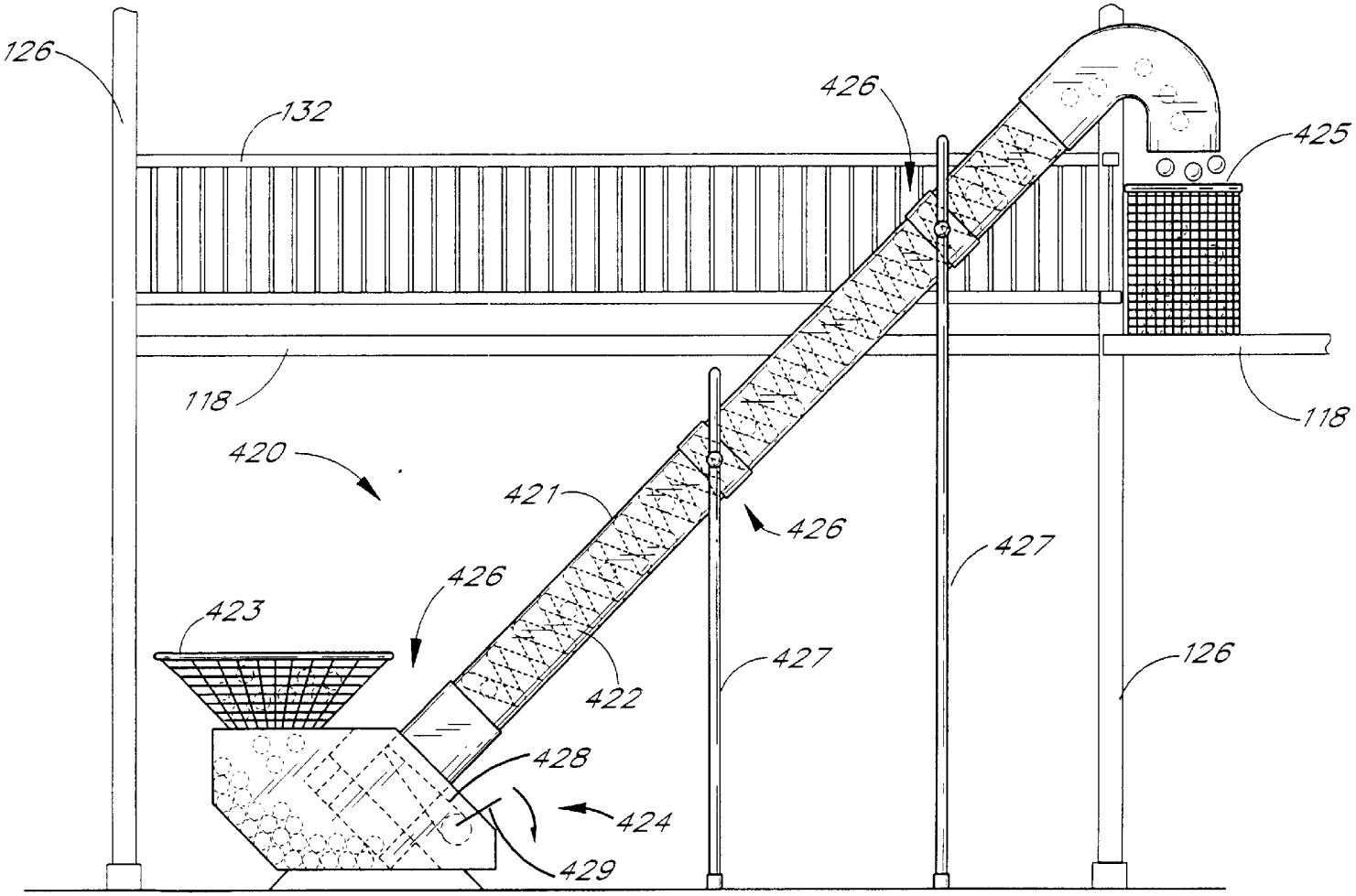
FIG. 40 is a side elevational view of an archimedes screw conveyor having features of the present invention.

FIG. 40 illustrates another possible interactive conveyor device provided in the form of an archimedes screw conveyor 420. The archimedes screw conveyor 420 comprises an outer tube 421 rotatably supported by a plurality of roller bearings 426. The tube 421 is inclined at an angle of between about 30 and 60 degrees and has at least one helical lip or groove 422 formed on the inner surface thereof, as shown.

The helical lip 422 is formed such that when the tube 421 is rotated in a preselected direction, play media 104 from a lower basket 423 is conveyed up the length of the tube 421 exiting into an upper basket 425. The tube is rotated by play participants using a suitable expedient, such as a hand crank, belt drive, stationary bicycle, tread mill or the like as described herein. For example, those skilled in the art will readily appreciate that a crank 429 may be adapted to turn a chain 428 or a series of gears or other drive mechanisms to rotate the tube 421. Optionally, the archimedes conveyor may be powered by a separate power source such as an electric motor or the like. The base of the archimedes screw conveyor may be rotatable in order to allow play participants to direct the output thereof.

The various conveyor systems described above may be linked with one another or with other passive, active, semi-active or interactive conveyor systems so as to extend over several locations or levels of the play structure. Thus, for example, the archimedes screw 420 may form but one part of a more complex interactive play effect that is comprised of a sequence of smaller effects, each operated by a number of different play participants cooperating together to create an overall desired effect. Passive collection devices and conveyors may also be used, such as collection basins, troughs, conveyor belts, pneumatic conduits, continuous belt elevators and the like, to collect and transport play media to the various areas of the play structure as needed. For example, drains and traps 140 (FIG. 4) may be provided at various locations in and around the play structure 100 to help collect spent play media 104. Collection lines 432 may be provided above or below the ground level to route play media to other collection areas such as sump 430. Play media may also be collected by a gently sloping perimeter gutter (not shown). A vacuum (not shown) may also be used to suck up play media and deliver it to a central accumulator. A control valve manifold (not shown) may be used to control the pressure and flow of air and play media in the various pneumatic conduits 124 of the play structure 100 and direct the number and size of play media 104 going to each connecting conduit and/or play element. Various gates and valves may be provided throughout the play structure to allow play participants to control the flow of play media to the various areas of the play stricture and to various effects.

Cleaning and/or decontamination devices may also be provided for continuously or periodically cleaning play media circulated throughout the play structure. These may be passive or interactive, as desired. For example, a chlorine bath may be provided in combination with brush or ultrasonic cleaner in order to remove dirt and contaminants from spent play media, as needed. Play participants may turn a crank or other input device to operate an interactive cleaner and watch as balls or other play media 104 slosh about the cleaner housing, which is preferably formed of a clear material. Drying of play media 104 may also be provided in a similar manner, as desired.

Passive Play Elements

The play structure 100 also preferably incorporates a number of other conventional (passive) play elements, such as climbing nets 108, crawl tunnels 112, swinging bridges 122, slides 110, and the like as shown in FIGS. 1–3. These provide entertaining physical challenges and allow play participants to safely negotiate their way through the various levels and platforms 118 of the play structure 100. Crawl tunnels 112 may be constructed of any variety of suitable materials such as clear plastic or fiberglass, or, more preferably, they may be constructed of a soft webbing or net material. Tunnels 112 may terminate next to a slide 110 or they may lead to another area of the structure 100, as desired.

Throughout the play structure 100, enclosure panels and/or safety netting are preferably provided around the various entrances to the slides 110 to prevent play participants 105 from falling off the play structure 100 or to complement a particular theme. Swinging bridges 122 allow play participants to traverse between the right and left sides, or front and rear, of the play structure 100. The use of hand rails 132, enclosure panels, and non-slip surfaces provides added safety in order to protect play participants 105 from possible injury.

Slides 110 may be provided at the front, rear, and/or sides of the play structure 100 and may be straight, curved, or spiral-shaped, as desired. They may also be enclosed and tube-like or open and exposed to flying play media, as desired. Alternatively, those skilled in the art will readily appreciate that the size, number, and location of the various slides 110 can be varied, as desired, while still enjoying the benefits and advantages of the present invention.

Multiple ball pits 111 may also be provided at various locations throughout the play structure. Play participants 105 can slide into the ball pit 111 as shown in FIG. 1 or they can jump into the pit 111 from a raised platform. Ball pits 111 may be of varying depths, as desired, taking into consideration the size of the play participants and the need to facilitate exiting of the pit 111 by play participants 105. Those skilled in the art will readily appreciate that a wide variety of other passive play elements, such as funny mirrors, rotating tunnels, trampolines, climbing bars, swings, etc. may all be used while still enjoying the features and advantages as of the present invention as taught herein.

Figure 41:
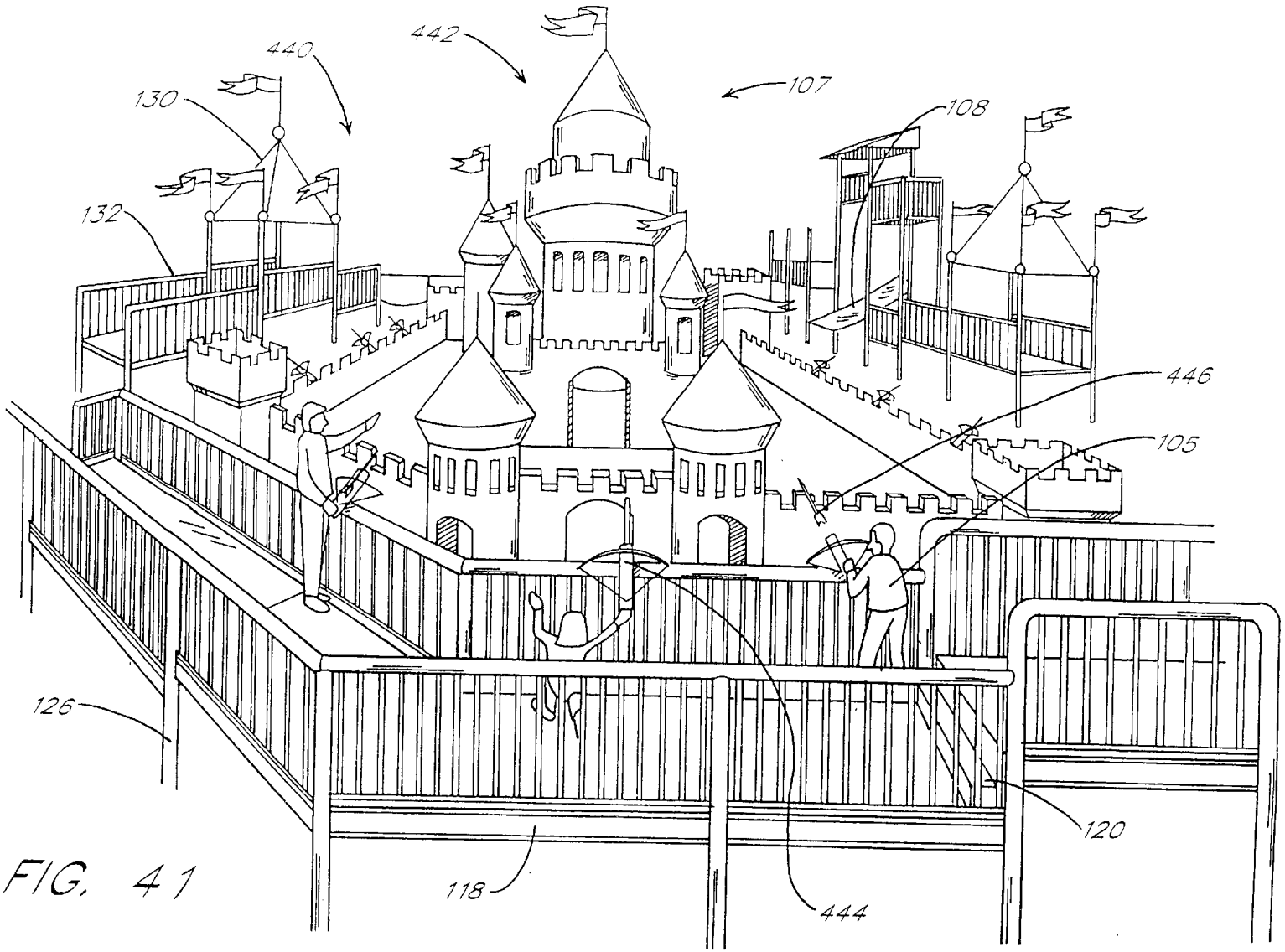
FIG. 41 is a perspective view of another embodiment of an interactive play structures having features of the present invention, provided in the theme of a medieval castle.

By way of example, FIG. 41 illustrates another embodiment of an interactive play structure 107 provided in the form of a medieval castle having catapults, mortars, crossbows and the like. The structure includes a central castle 440 having a tower 442 disposed in a "war zone" area. Such a play structure may include, for example, a series of crossbows or catapults for use with moving or fixed targets and can be adapted for individual or team play.

Although the present invention has been disclosed in the context of certain preferred embodiments, it will be understood by those skilled in the art that the present invention extends beyond the specifically disclosed embodiments to other alternative embodiments. Thus, it is intended that the scope of the present invention herein disclosed should not be limited by the particular disclosed embodiments herein, but shall be defined only by the claims which follow.

What is claimed is:

1. A play structure for amusing or entertaining one or more play participants comprising:

a support structure for safely supporting one or more play participants;

a source of play media comprising a plurality of discrete play articles, said play articles comprising an impact-safe foam or plastic ball or projectile; and means provided in, on, or around the support structure for allowing play participants to create desired effects using the play media, said effects creating means comprising at least one projectile accelerator for accelerating or shooting said play media at one or more targets or other play participants.

2. The play structure in accordance with claim 1, wherein the play media comprises soft foam, balls.

3. The play structure in accordance with claim 1, wherein the play media comprises hollow plastic balls.

4. The play structure in accordance with claim 1, wherein the play media comprises soft foam balls.

5. The play structure in accordance with claim 1, wherein the projectile accelerator comprises a pump-gun accelerator.

6. The play structure in accordance with claim 1, wherein the projectile accelerator comprises a cannon accelerator.

7. The play structure in accordance with claim 1, wherein the projectile accelerator comprises a catapult, cross-bow or sling-shot accelerator.

8. The play structure in accordance with claim 1, wherein the effects creating means comprises at least one spilling basket adapted to be filled or emptied by play participants.

9. The play structure in accordance with claim 1, wherein the effects creating means comprises at least one a geyser adapted to eject play media generally upward.

10. The play structure in accordance with claim 1, wherein the effects creating means comprises at least one second-order play element adapted to receive play media from a first effect to create a second effect.

11. The play structure in accordance with claim 1, further comprising play participant operated means mounted in, on, or around the support frame for circulating or transporting the play media to the effects creating means.

12. The play structure in accordance with claim 11, wherein the play media circulating means comprises one or more hollow pneumatic conduits.

13. A play structure for amusing or entertaining play participants comprising:

a support structure for safely supporting one or more play participants;

play media comprising a plurality of discrete play articles, said play articles comprising impact-safe foam or plastic balls or projectiles disposed in, on or around the support structure; and a plurality of interactive play elements provided in, on, or around the support structure for allowing play participants to create desired effects using the play media, wherein at least one of the interactive play elements comprises a projectile accelerator adapted to allow a play participant to accelerate or shoot play media at one or more targets or other play participants or to achieve a desired effect.

14. The play structure in accordance with claim 13, wherein at least one of the interactive play elements comprises a second-order play element adapted to receive play media from a first effect to create a second effect.

15. The play structure in accordance with claim 13, further comprising play participant operated means for circulating or transporting the play media to one or more of the interactive play elements.

16. A play structure for amusing or entertaining play participants using a plurality of discrete play articles comprising impact-safe foam or plastic balls or projectiles, said play structure comprising:

a support frame for safely supporting one or more play participants; and a plurality of interactive play elements provided in, on, or around the support frame for allowing play participants to create desired effects using the play media, wherein at least one of the interactive play elements comprises a projectile accelerator adapted to allow a play participant to accelerate or shoot play media at one or more targets other play participants.

17. The play structure in accordance with claim 16, wherein the projectile accelerator comprises a pump-gun, catapult, cross-bow or sling-shot accelerator.

18. The play structure in accordance with claim 16, wherein at least one of the interactive play elements comprises a spilling basket adapted to be filled or emptied by play participants.

19. The play structure in accordance with claim 16, wherein at least one of the interactive play elements comprises a geyser adapted to eject play media generally upward.

20. The play structure in accordance with claim 16, wherein at least one of the interactive play elements comprises a second-order play element adapted to receive play media from a first effect to create a second effect.

21. The play structure in accordance with claim 16, further comprising play participant operated means mounted in, on, or around the support frame for circulating or transporting the play media to one or more of the interactive play elements.

22. A play structure for amusing and entertaining play participants using pneumatically propelled impact-safe projectiles comprising:

a plurality of support members assembled together in cooperative relationship to form a support frame and/or elevated platform for safely supporting one or more play participants thereon;

at least one play-participant-actuated pneumatic accelerator mounted and arranged on the support frame so as to receive one or more of said impact-safe projectiles, said at least one pneumatic accelerator being operable by one or more play participants to impart energy to said one or more impact-safe projectiles so as to pneumatically propel said one or more projectiles into the air and/or at a selected target;

whereby the play structure enables play participants to safely observe and experiment with various pneumatic effects.

23. The play structure of claim 22 wherein said at least one play-participant-actuated pneumatic accelerator comprises a solenoid-activated pneumatic accelerator.

24. The play structure of claim 22 wherein a source of compressed air is provided in pneumatic communication with said at least one play-participant-actuated pneumatic accelerator.

25. The play structure of claim 22 wherein said one or more impact-safe projectiles comprise foam balls.

26. The play structure of claim 25 further comprising one or more conduits for supplying said foam balls from a collection source to said at least one play-participant-actuated pneumatic accelerator.

27. The play structure of claim 26 further comprising means for transporting or circulating said foam balls through said one or more conduits using pressurized air.

28. The play structure of claim 26 wherein said one or more conduits comprise clear or colored transparent pneumatic conduits having an inner diameter of between about 2" and 6½".

29. The play structure of claim 22 further comprising at least one interactive target adapted to produce various desired effects when struck by one or more of said pneumatically propelled impact-safe projectiles.

* * * * *